US008952857B2

(12) United States Patent
Diaz

(10) Patent No.: US 8,952,857 B2
(45) Date of Patent: Feb. 10, 2015

(54) ANTENNAS WITH BROADBAND OPERATING BANDWIDTHS

(75) Inventor: Rodolfo E. Diaz, Phoenix, AZ (US)

(73) Assignee: Arizona Board of Regents, A Body Corporate of the State of Arizona Acting for and on Behalf of Arizona State University, Scottsdale, AZ (US)

( * ) Notice: Subject to any disclaimer, the term of this patent is extended or adjusted under 35 U.S.C. 154(b) by 853 days.

(21) Appl. No.: 13/061,263

(22) PCT Filed: Aug. 31, 2009

(86) PCT No.: PCT/US2009/055565
§ 371 (c)(1),
(2), (4) Date: Feb. 28, 2011

(87) PCT Pub. No.: WO2010/025470
PCT Pub. Date: Mar. 4, 2010

(65) Prior Publication Data

US 2011/0156977 A1 Jun. 30, 2011

Related U.S. Application Data

(60) Provisional application No. 61/093,279, filed on Aug. 29, 2008.

(51) Int. Cl.

| | |
|---|---|
| ***H01Q 1/38*** | (2006.01) |
| ***H01Q 13/10*** | (2006.01) |
| ***H01Q 13/02*** | (2006.01) |
| ***H01Q 9/04*** | (2006.01) |
| ***H01Q 9/28*** | (2006.01) |

(52) U.S. Cl.
CPC ..... *H01Q 13/0225* (2013.01); *H01Q 9/0421* (2013.01); *H01Q 9/285* (2013.01)
USPC ..... 343/772; 343/700 MS

(58) Field of Classification Search
CPC ..... H01Q 1/38; H01Q 21/26; H01Q 9/0407; H01Q 9/0421
USPC ..... 343/700 MS, 797, 749, 751, 752, 772
See application file for complete search history.

(56) References Cited

U.S. PATENT DOCUMENTS

| | | | | |
|---|---|---|---|---|
| 7,932,869 | B2 * | 4/2011 | Han et al. | 343/787 |
| 2003/0210191 | A1 | 11/2003 | Mohammadian et al. | |
| 2009/0027294 | A1 * | 1/2009 | Bourry et al. | 343/848 |

FOREIGN PATENT DOCUMENTS

| | | | |
|---|---|---|---|
| JP | 2006325178 | A | 11/2006 |

OTHER PUBLICATIONS

Nam, Yun Kwon, Authorized officer, Korean Intellectual Property Office, in Written Opinion of the International Search Report, dated May 17, 2010, in International Application No. PCT/US2009/055565, filed on Aug. 31, 2009, 9 pages.

* cited by examiner

*Primary Examiner* — Robert Karacsony
(74) *Attorney, Agent, or Firm* — Fish & Richardson P.C.

(57) ABSTRACT

Designs and operations of momentum antennas are presented. In some antenna designs, the terminating discontinuities are complementary with the opposite transmission line's discontinuity. In other antenna designs, the terminating discontinuities are intrinsically self-complementary.

6 Claims, 29 Drawing Sheets

Momentum antenna of Type 1: Device 3 -
H-plane Cross-polar radiation pattern

Momentum antenna of Type 1: Device 3 -
H-plane Cross-polar radiation pattern (continued)

Momentum antenna of Type 1: Device 3 -
E-plane Co-polar radiation pattern

Momentum antenna of Type 1: Device 3 -
E-plane Co-polar radiation pattern (continued)

Momentum antenna of Type 1: Device 3 -
H-plane Co-polar radiation pattern

ANTENNAS WITH BROADBAND OPERATING BANDWIDTHS

CROSS REFERENCE TO RELATED APPLICATIONS

This patent document is a §371 National Stage Application of International Patent Application No. PCT/US2009/055565, filed Aug. 31, 2009, and claims priority under 35 U.S.C. §119(e) to U.S. Provisional Application Ser. No. 61/093,279, entitled "Momentum Antennas And Other Antennas With Broadband Operating Bandwidths," and filed by Rodolfo E. Diaz on Aug. 29, 2008. The entire disclosure of the foregoing applications is incorporated herein by reference.

TECHNICAL FIELD

This document relates to antennas for transmitting and receiving electromagnetic waves in wireless communications, radar systems and other applications.

BACKGROUND

Antennas in various configurations exhibit limited bandwidths. For some applications, it is desirable to have antennas with broadband bandwidths. As an example, certain communication systems and radar systems need to operate over broad bands of frequency, e.g., bandwidth ratios greater than 2:1 and even 10:1. Performance of certain communication systems and radar systems may be limited by the operational bandwidths of the antennas, especially so if the antennas are required to be compact in size (e.g., electrically small) or limited to a low-profile above the surface of a conducting (metallic) platform (e.g. a vehicle, a tank, an aircraft, etc). Many compact antennas are resonant antenna circuits and therefore have operational bandwidth ratios typically less than 1.1:1 (10%) limited to the resonant frequencies at which the resonant antennas operate. A wide band of frequencies can be achieved by using an actively tuned resonant antenna or using multiple resonant antennas that operate at different center frequencies. Examples of broadband resonant antennas include spiral antennas or log-periodic dipole arrays. The spiral antenna is unique in that its resonance occurs over a smooth continuum of frequencies because the antenna geometry scales with frequency. Nevertheless the radiation occurs from a resonant active region. Broadband resonant antennas may become inefficient when placed a short distance above a conducting surface and may be required to be loaded with absorbing materials to recover their wide bandwidth at the expense of efficiency loss due to loss of near field power into the absorbing materials.

SUMMARY

Techniques, devices and systems are described to provide non-resonant momentum antenna designs for antenna applications.

In one aspect, an antenna device is provided to include an electromagnetic waveguiding structure that includes a signal feed port and matched waveguiding discontinuities that have reflection coefficients that are equal in magnitude and opposite in phase to each other.

The electromagnetic waveguiding structure further includes a ground plate formed of an electrically conductive material to provide an electrical ground and having an aperture; a transmission line formed above the ground plate having a first terminal end that is connected to the ground plate to form a first waveguiding discontinuity and a second terminal end that is isolated from the ground plate to form an open circuit to form a second waveguiding discontinuity; and a feed line passing through the aperture to connect to a middle point of the transmission line between the first and second terminals to feed an electrical pulse of an antenna signal into the transmission line for transmission out of the antenna device or to receive an electrical pulse of an antenna signal received by the antenna device. The electromagnetic waveguiding structure is structured to be a non-resonant momentum antenna structure.

Furthermore, the electromagnetic waveguiding structure includes a ground plate formed of an electrically conductive material to provide an electrical ground and having an aperture; a first transmission line formed above the ground plate having a first terminal end that is connected to the ground plate to form a first waveguiding discontinuity and a second terminal end that is isolated from the ground plate to form an open circuit to form a second waveguiding discontinuity; a second transmission line formed above the ground plate having a third terminal end that is connected to the ground plate to form a third waveguiding discontinuity and a fourth terminal end that is isolated from the ground plate to form an open circuit to form a second waveguiding discontinuity, the second transmission line having a second middle point that is connected to the first transmission line at the middle point of the first transmission line and the feed line passing through the aperture. The electromagnetic waveguiding structure is structured to be a non-resonant momentum antenna structure.

In another aspect, an antenna device is provided to include a ground plate formed on an electrically conductive material to provide an electrical ground; an electrically conductive transmission line disposed parallel to, and at a finite distance above the ground plate; and a feed connector that is inserted through an aperture of the ground plate and is isolated from the ground plate. A first terminal of the feed connector connects to a transceiver circuit placed under the ground plate, and a second terminal of the feed connector connects to about a middle point of the transmission line. The transmission line is terminated at an end in a short circuit terminal connected to the ground plate, and is terminated at another end in an open circuit terminal. The short circuit terminal and the open circuit terminal are configured to have an admittance associated with the short circuit terminal that matches an impedance associated with the open circuit terminal. The antenna device further includes a second electrical conductive transmission line disposed parallel to, and at the same finite distance above the ground plate as the transmission line, and oriented orthogonally to the transmission line. The second transmission line shares the feed connector with the transmission line, and the second terminal of the feed connector connects to about a middle point of the second transmission line. The second transmission line is terminated at an end in a second short circuit terminal connected to the ground plate, and is terminated at another end in a second open circuit terminal. The second short circuit terminal and the second open circuit terminal are configured to have a second admittance associated with the second short circuit terminal that matches a second impedance associated with the second open circuit terminal.

In some other aspect, an antenna device is provided to include a ground plate formed on an electrically conductive material to provide an electrical ground; a rectangular strip having a long axis disposed parallel to the ground plate, having a short axis perpendicular to the ground plate, and having a center of the strip disposed above an aperture of the ground plate. The strip is separated by a finite distance from the ground plate. The antenna structure further to include a feed line having a first terminal connected with transceiver circuitry disposed under the ground plate, and a second terminal that has a shield connected to the aperture of the ground plate, and a center connector of the feed line that reaches through the aperture of the ground plate to contact the center of the strip. The strip has an edge perpendicular to the ground plate that is terminated in a conductive plate to provide a short circuit terminal connected to the ground plate. The strip has another edge perpendicular to the ground plate that is terminated in an open circuit terminal including a perfect magnetic conductor (PMC) choke. The short circuit terminal and the open circuit terminal are configured to have an admittance associated with the short circuit terminal that matches an impedance associated with the open circuit terminal. The antenna device further to include a second rectangular strip having a second long axis disposed parallel to the ground plate and perpendicular to the long axis of the strip, and having a second short axis perpendicular to the ground plate, and having a center of the second strip disposed above the aperture of the ground plate. The second strip is separated by the same finite distance from the ground plate as the strip, and a length of the second strip is different from a length of the strip. The center connector of the feed line that reaches through the aperture of the ground is in contact with the center of the second strip. The second strip has an edge perpendicular to the ground plate that is terminated in a second conductive plate to provide a second short circuit terminal connected to the ground plate. The second strip has another edge perpendicular to the ground plate that is terminated in a second open circuit terminal including a second PMC choke. The second short circuit terminal and the second open circuit terminal are configured to have a second admittance associated with the second short circuit terminal that matches a second impedance associated with the second open circuit terminal.

In an additional aspect, an antenna device is provided to include a ground plate formed on an electrically conductive material to provide an electrical ground; a bar having a rectangular cross section, having a side surface disposed parallel to the ground plate, and being disposed above an aperture of the ground plate. The bar is separated by a finite distance from the ground plate. The rectangular cross section of the bar has two perpendicular sides of comparable dimensions to render the antenna device in a "fatline" type 1 momentum antenna configuration. The bar has an end-face that is terminated in a conductive plate to provide a short circuit terminal connected to the ground plate. The bar has another end-face that provides an open circuit terminal. The antenna device further to include a feed line having a first terminal connected with transceiver circuitry disposed under the ground plate, and a second terminal that has a shield connected to the aperture of the ground plate, and a center connector of the feed line that reaches through the aperture of the ground plate to contact the bar off-center and closer to the other end-face of the bar. The short circuit terminal is configured to have an admittance associated with the short circuit terminal that matches an impedance associated with the open circuit terminal. The impedance is associated with the cross section of the bar.

In some additional aspect, an antenna device is provided to include a ground plate formed on an electrically conductive material to provide an electrical ground; a first and a second strip lines that are placed above, parallel to, and each of the first and second strip lines in direct contact with the ground plate, the first and second strip lines being fabricated from a perfect magnetic conductor (PMC); and a feed structure placed above, parallel to, and in contact with the ground plate. The feed structure connects the middle of the first strip line with the middle of the second strip line. The feed structure is fabricated from PMC and is configured to couple time domain pulses into the first and the second strip lines. The antenna device is provided to further include a shorting-connector placed above, parallel to, and in contact with the ground plate. The shorting-connector is fabricated from PMC and connects an end of the first strip line to an end of the second strip line to provide a short circuit terminal for the conformal antenna device. The antenna device also includes a pair of the other end of the first strip line and the other end of the second strip line provides an open circuit terminal for the conformal antenna device. The short circuit terminal is configured to have an admittance associated with the short circuit terminal that matches an impedance associated with the open circuit terminal.

In another aspect, an antenna device is provided to include an electromagnetic waveguiding structure that includes a signal feed port and matched waveguiding discontinuities that are configured to be reflectionless to a signal received from the feed port.

The electromagnetic waveguiding structure further to include an electrical conductor providing an electrical conducting surface as an electrical ground; two magnetic conductor walls formed parallel to each other and having first terminal ends connected to the electrical conducting surface as a first waveguiding discontinuity and second terminal ends forming an open circuit as a second waveguiding discontinuity, the two magnetic conductor walls oriented to be perpendicular to the electrical conducting surface at the first terminal ends; and a feed line coupled to the first terminal ends of the two magnetic conductor walls to feed an electrical pulse of an antenna signal for transmission out of the antenna device or to receive an electrical pulse of an antenna signal received by the antenna device. The electromagnetic waveguiding structure is structured to be a non-resonant momentum antenna structure.

In yet another aspect, an antenna device is provided to include a transverse electromagnetic (TEM) waveguide shaped as a hollow rectangular tube, the TEM waveguide including opposite sides formed by a first and a second electrical conducting plates, other opposite sides formed by a first and a second perfect magnetic conductor (PMC) walls. The remaining open sides represent apertures of the antenna device. The antenna device to further include a feed port attached to the antenna structure to couple time domain pulses inside the TEM waveguide. The apertures of the antenna device are reflectionless waveguiding discontinuities to the time domain pulses coupled inside the TEM waveguide.

In some aspect, an antenna device is provided to include a ground plate formed on an electrically conductive material to provide an electrical ground; a transverse electromagnetic (TEM) waveguide being disposed above a feed-aperture of the ground plate. The TEM waveguide includes two parallel perfect magnetic conductor (PMC) walls placed perpendicular on the ground plate and connected at the top by a conducting plate that is parallel to the ground plate. The openings of the TEM waveguide represent apertures of the antenna device. The antenna device to further include a feed line having a first terminal connected with transceiver circuitry disposed under the ground plate, and a second terminal that has a shield connected to the feed-aperture of the ground plate, and a center connector of the feed line that reaches through the feed-aperture of the ground plate to contact a bottom surface of the top conducting plate. The feed line to couple time domain pulses inside the TEM waveguide. The apertures of the antenna device are reflectionless waveguiding discontinuities to the time domain pulses coupled inside the TEM waveguide.

In another aspect, an antenna device is provided to include a ground plate formed on an electrically conductive material to provide an electrical ground; a transverse electromagnetic (TEM) crossed waveguide placed above the ground plate and centered on a feed-aperture of the ground plate. The TEM crossed waveguide includes a first and second hollow rectangular tubes that have identical dimensions, and that are orthogonally crossed. The crossed hollow rectangular tubes are disposed to have common centers. The crossed TEM waveguide has a perfect electric conductor (PEC) top plate and perfect magnetic conductor (PMC) walls, and a base of the crossed TEM waveguide is the ground PEC plate. The first hollow rectangular tube of the crossed TEM waveguide has openings corresponding to a first and a second apertures of the antenna device, and the second hollow rectangular tube of the crossed TEM waveguide has openings corresponding to a third and a fourth apertures of the antenna device. The antenna device further to include a feed line having a first terminal connected with transceiver circuitry disposed under the ground plate, and a second terminal that has a shield connected to the feed-aperture of the ground plate, and a center connector of the feed line that reaches through the feed-aperture of the ground plate to contact the top conducting plate. The feed line to couple time domain pulses inside the crossed TEM waveguide. The first and second apertures of the antenna device are reflectionless waveguiding discontinuities to the time domain pulses coupled inside the crossed TEM waveguide along a first direction, and the third and fourth apertures of the antenna device are reflectionless waveguiding discontinuities to the time domain pulses coupled inside the crossed TEM waveguide along a second direction, orthogonal to the first direction.

These and other aspects are described in greater detail in the drawings, the description and the claims.

The radiation patterns have been measured and simulated in the H- and E-planes, at multiple polarizations and at multiple frequencies.

Figure 7:
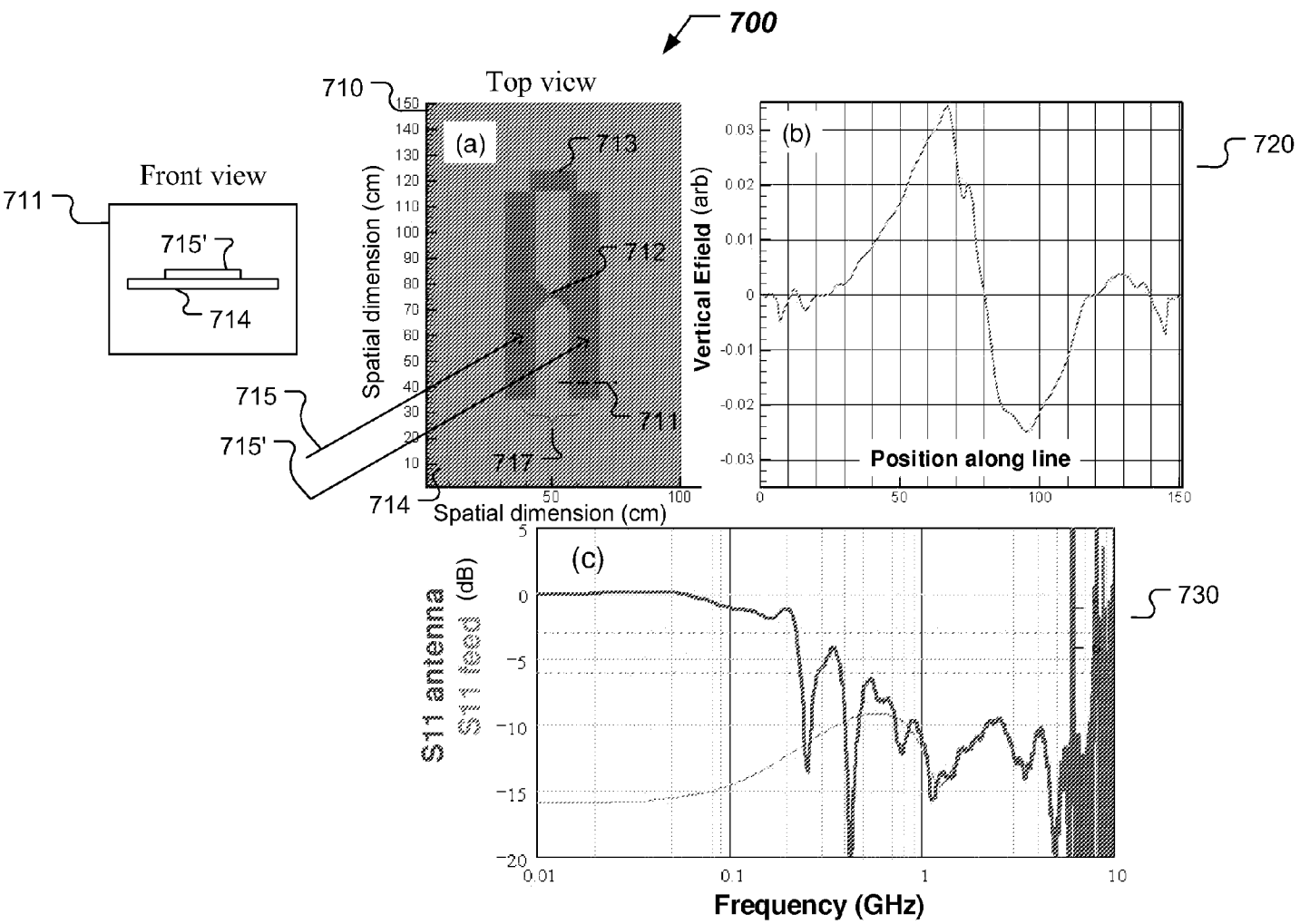

FIG. 7 shows a top view of a first example structure of a zero-volume antenna; and simulations for the first example structure of the zero-volume antenna, including the electric field at a given time vs. position along the device, and the reflection coefficient vs. frequency (over broad band—up to 10 GHz).

Figure 8:
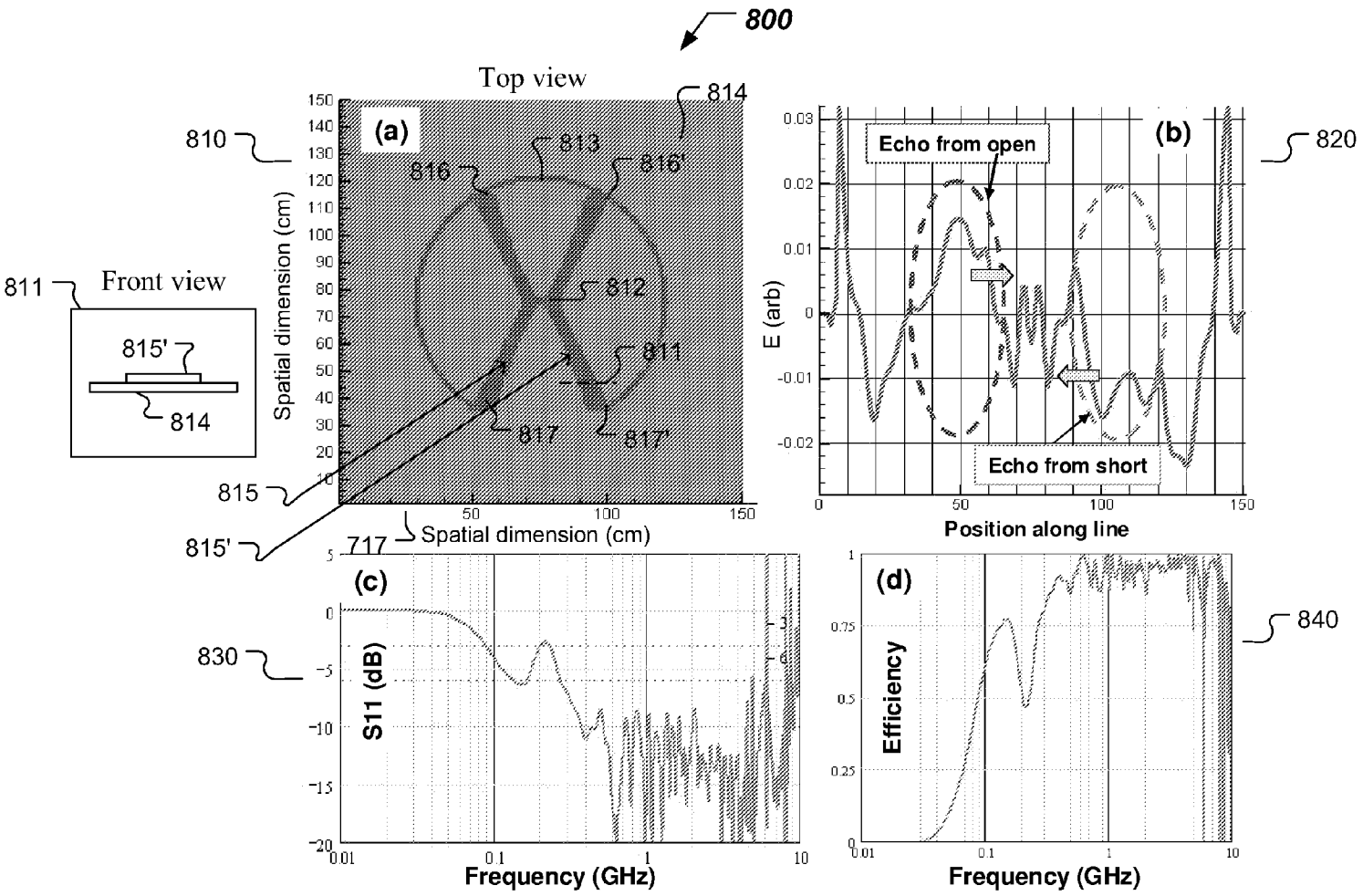

FIG. 8 shows a top view of a second example structure of a zero-volume antenna; and simulations for the second example structure of the zero-volume antenna, including the electric field at a given time vs. position along the device, the reflection coefficient vs. frequency (over broad band—up to 10 GHz), and the efficiency vs. frequency (over broad band—up to 10 GHz).

Figure 9:
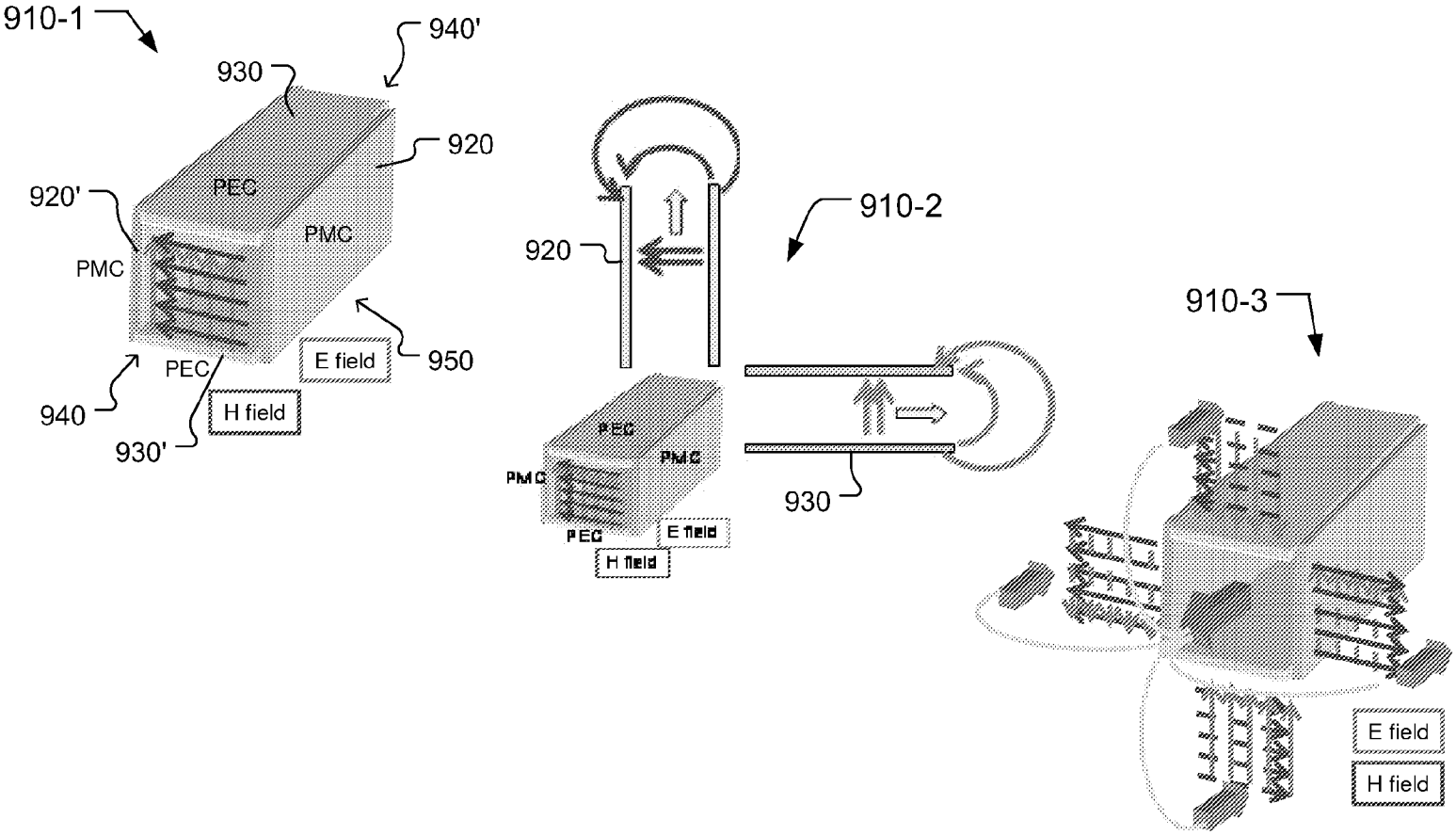

FIG. 9 shows a schematic representation of an example TEM waveguide structure of a type 2 momentum antenna.

Figure 10:
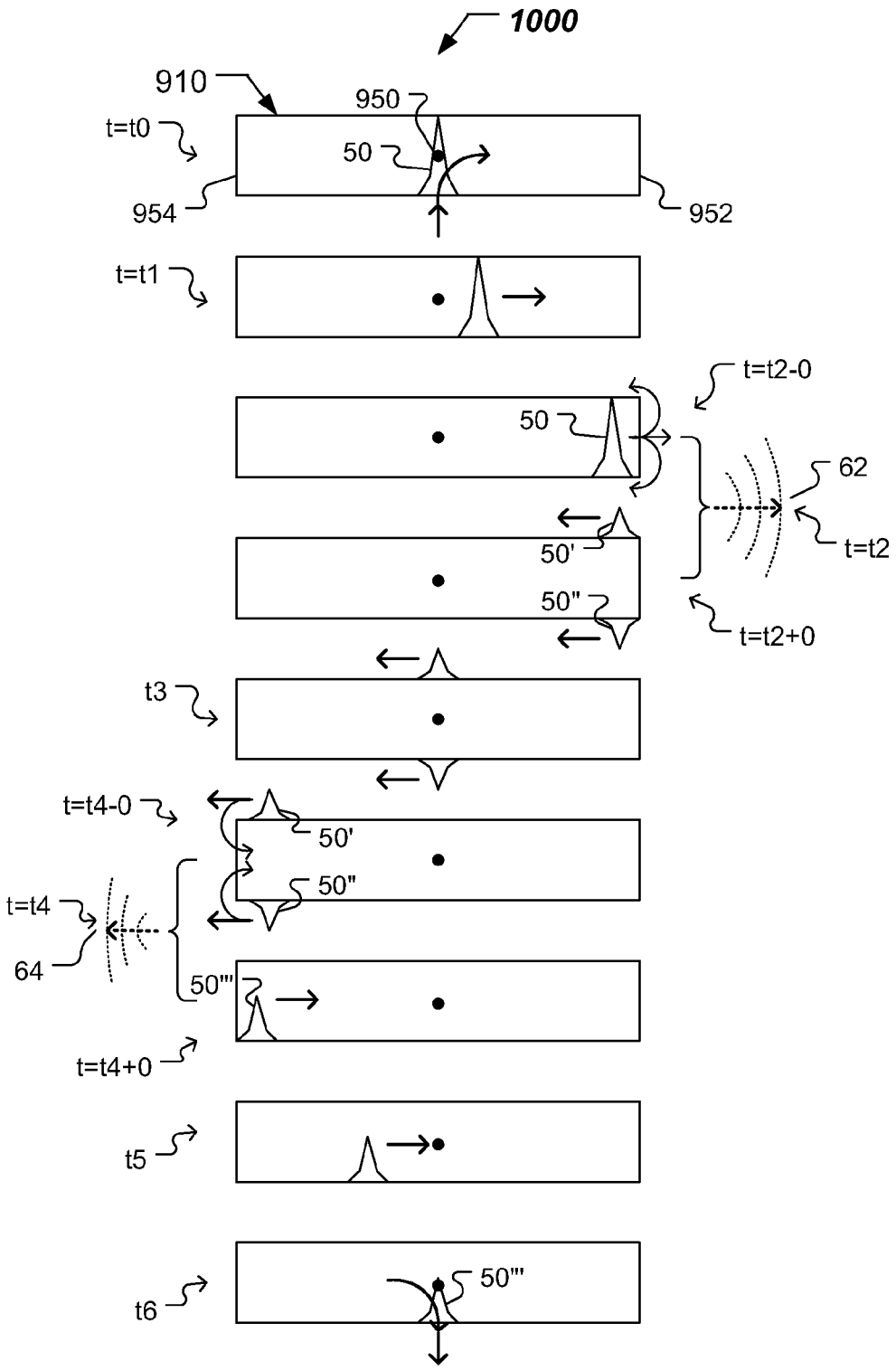

FIG. 10 shows a schematic representation of an example TEM waveguide structure of a type 2 momentum antenna, and shows successive time instances of the electric field vs. location along the structure for a pulse fed to the type 2 momentum antenna.

Figure 11:
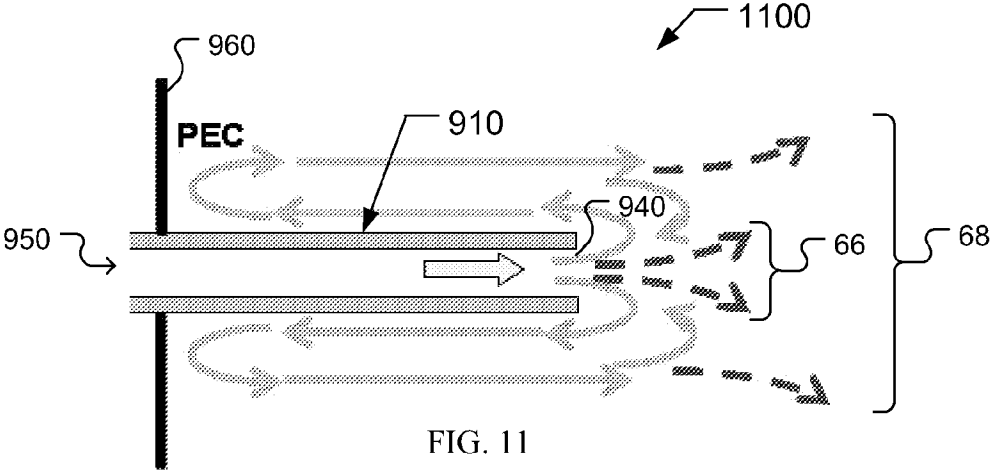

FIG. 11 shows a side view of a first example structure of a type 2 momentum antenna.

Figure 12:
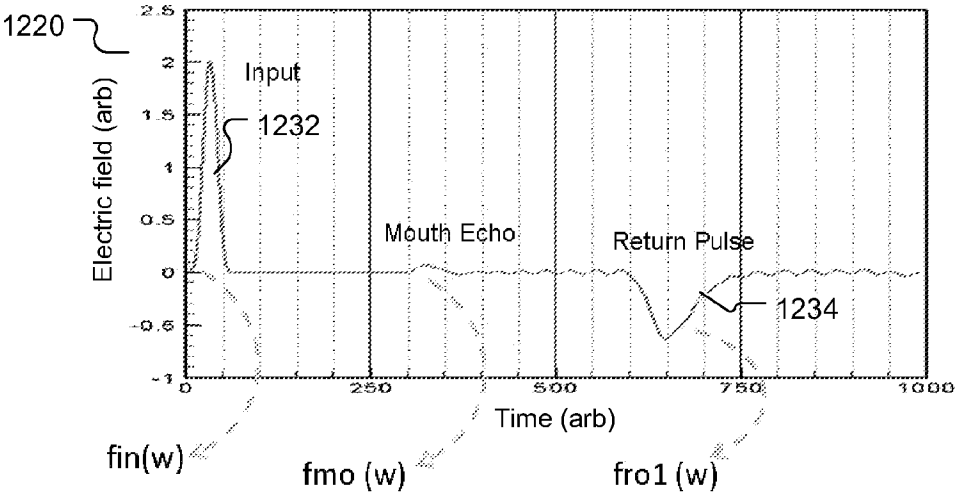

FIG. 12 shows a simulation of the electric field vs. time at the feed of the first example structure of a type 2 momentum antenna.

Figure 13:
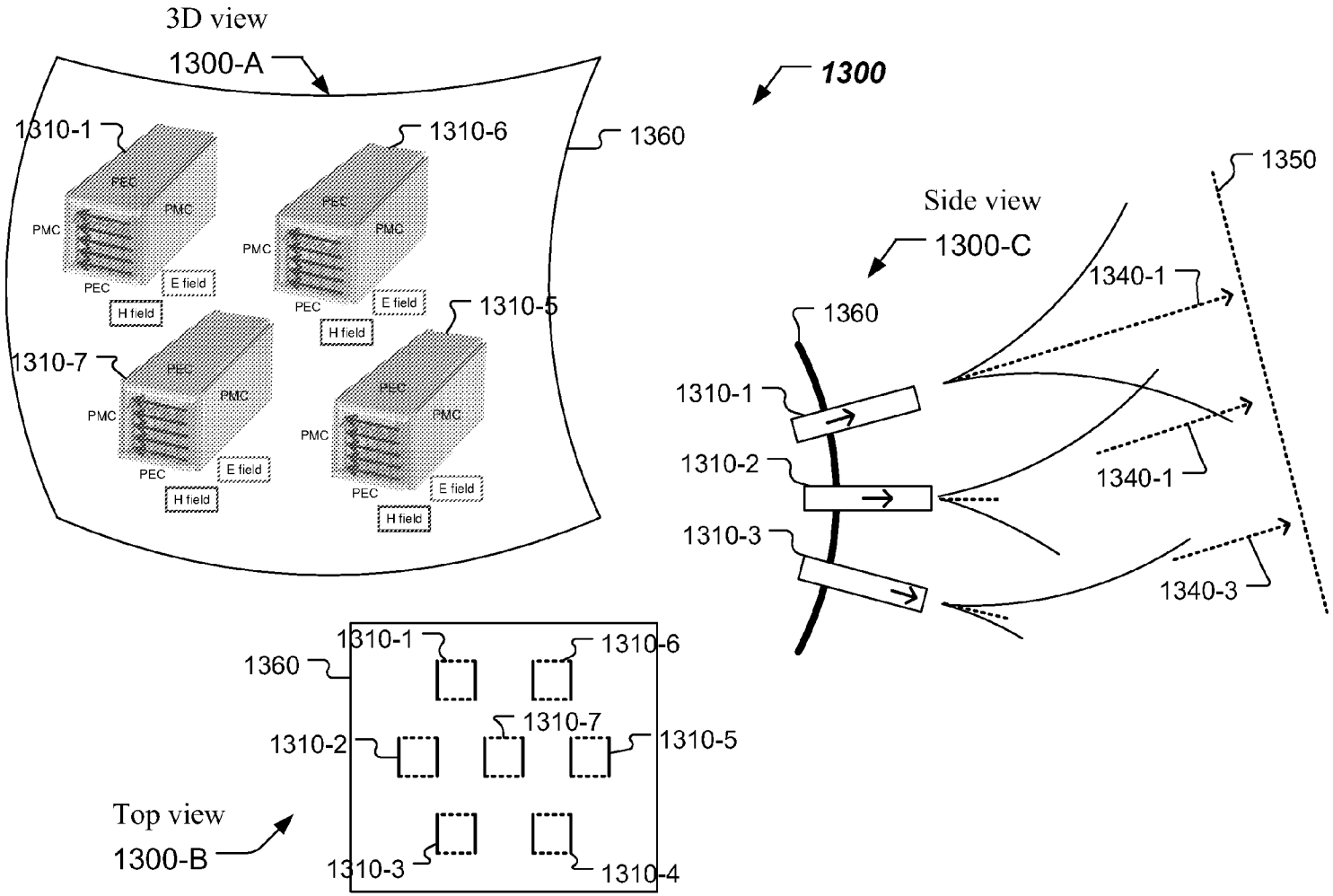

FIG. 13 shows a 3-D perspective view, a top view, and a side view of an example phase-array antenna structure based on the first example structure of the type 2 momentum antenna.

Figure 14A:
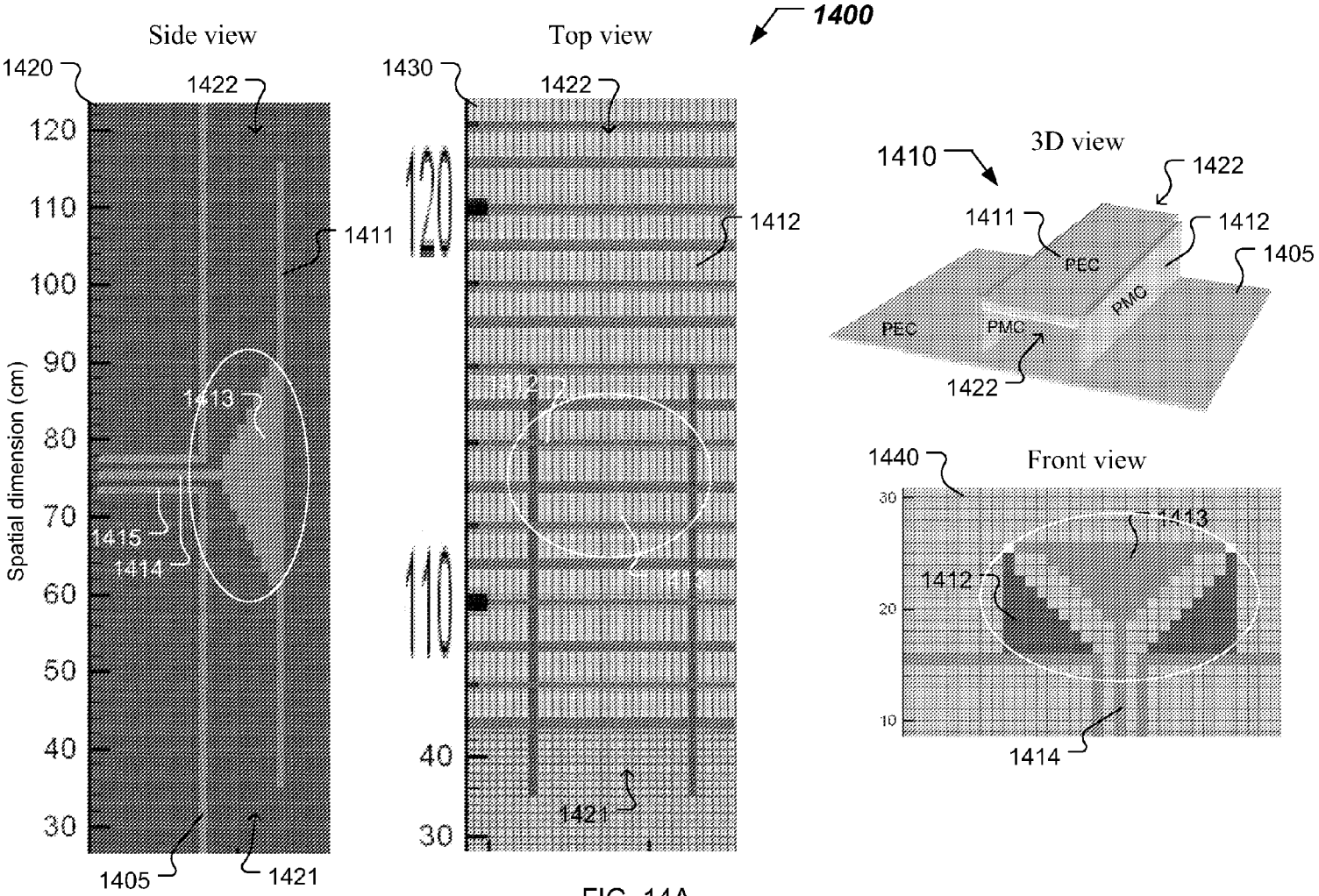

FIG. 14A shows a side view, a top view, a front view, and a 3-D perspective view of a second example structure of a type 2 momentum antenna.

Figure 14B:
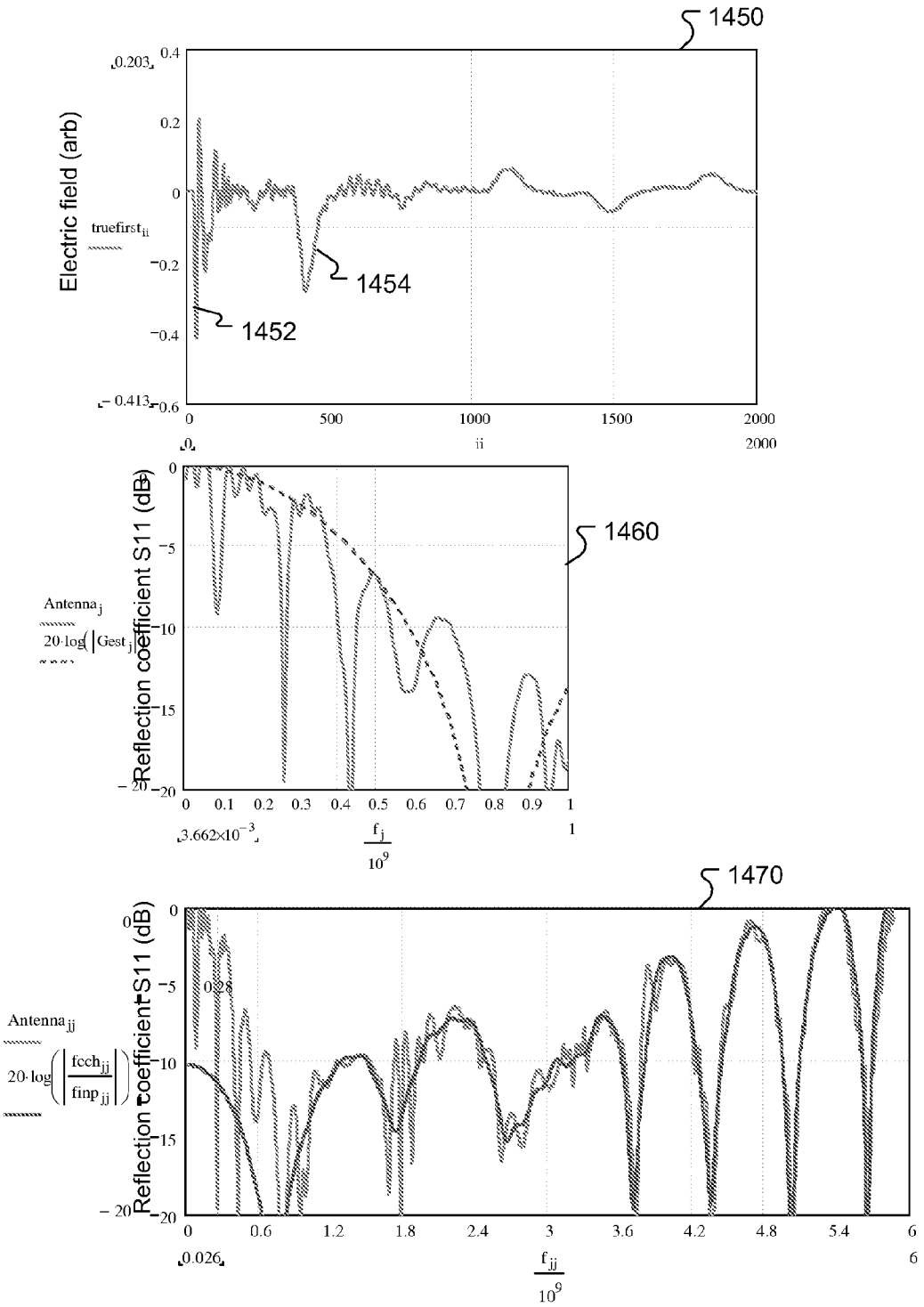

FIG. 14B shows simulations for the second example structure of the type 2 momentum antenna shown in FIG. 14A, including the electric field at the device feed vs. time, and the reflection coefficient vs. frequency (over low band—up to 1 GHz, and over broad band—up to 6 GHz).

Figure 15A:
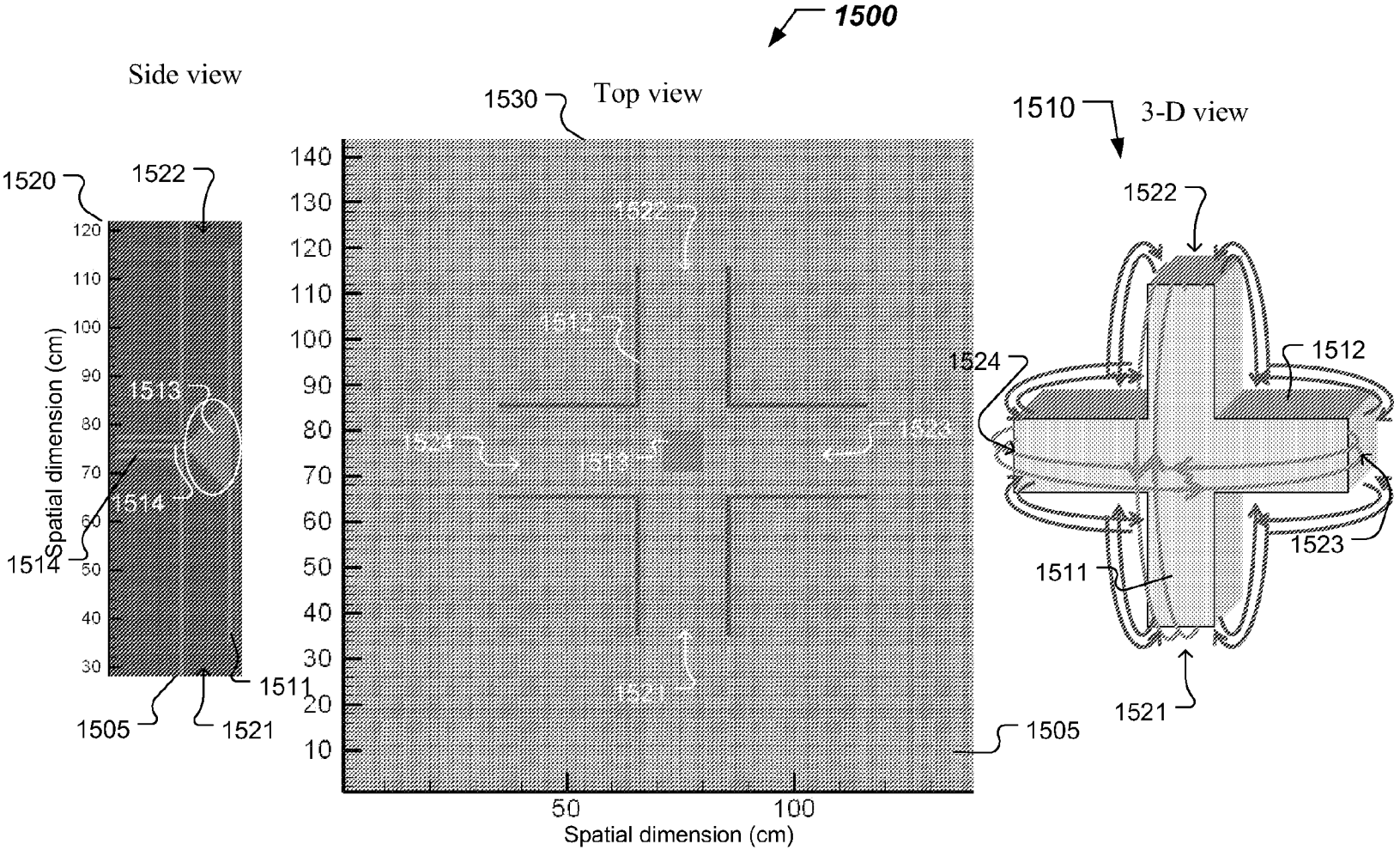

FIG. 15A shows a side view, a top view, and a 3-D perspective view of a third example structure of a type 2 momentum antenna.

Figure 15B:
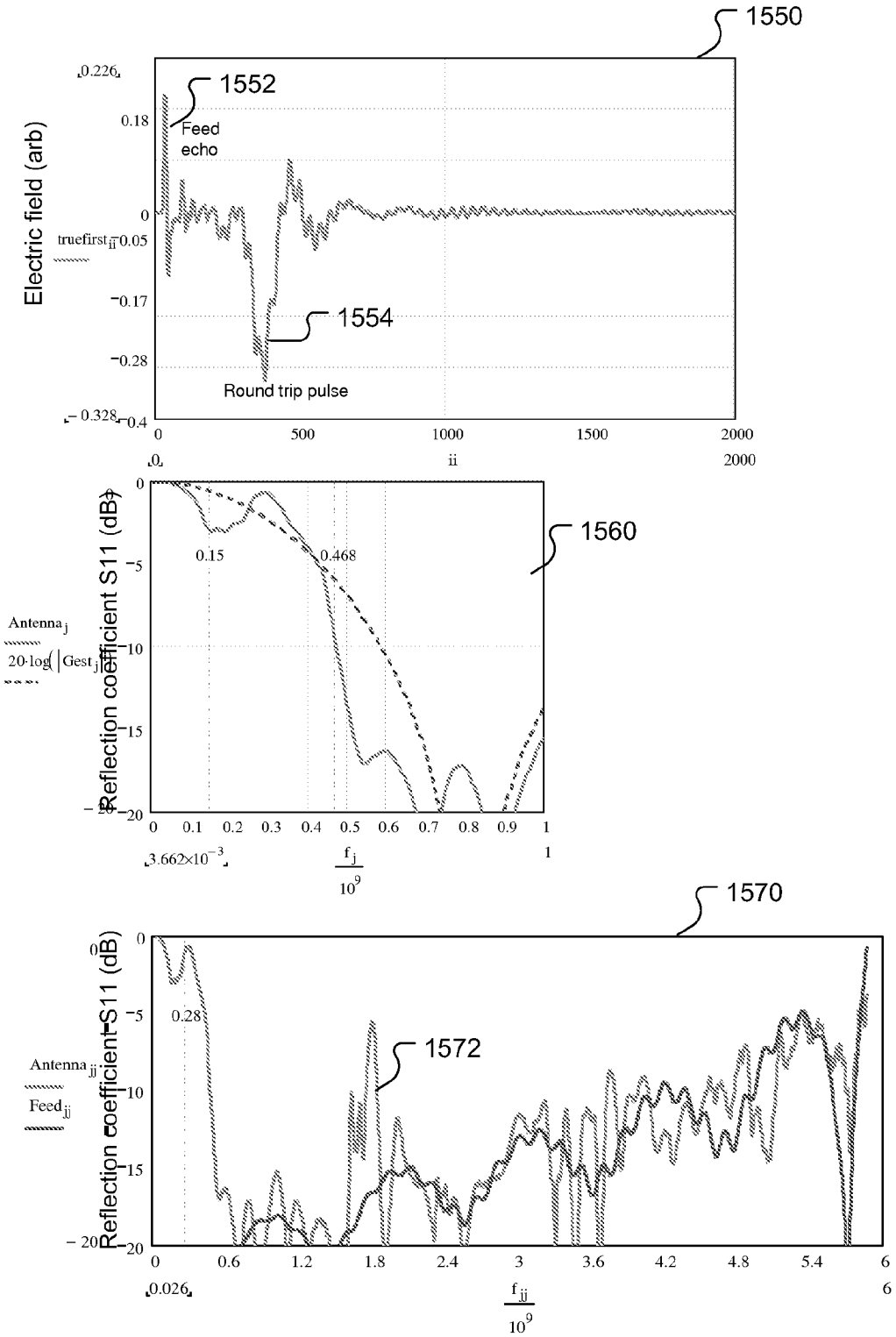

FIG. 15B shows simulations for the third example structure of the type 2 momentum antenna shown in FIG. 15A, including the electric field at the device feed vs. time, and the reflection coefficient vs. frequency (over low band—up to 1 GHz, and over broad band—up to 6 GHz).

Figure 16A:
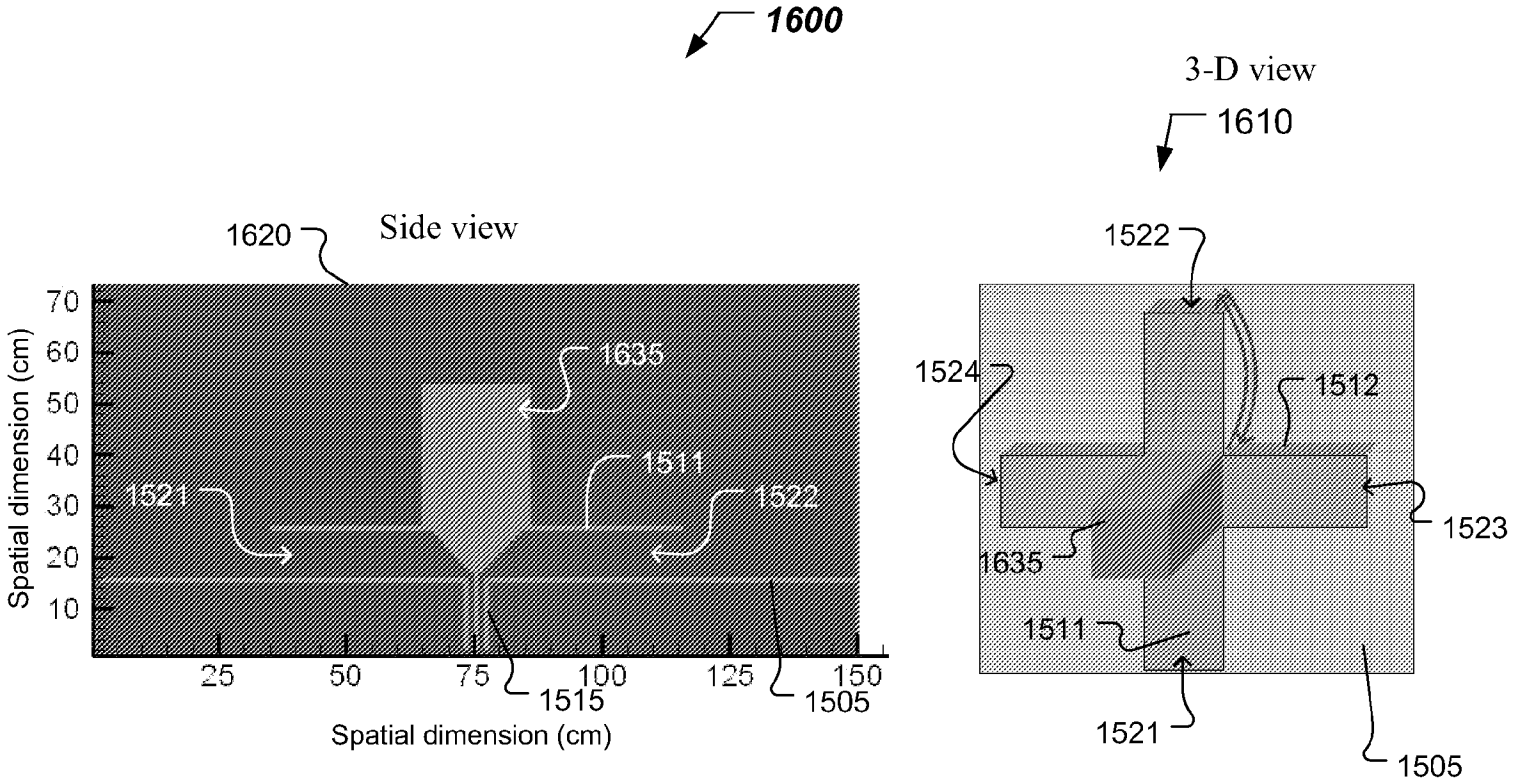

FIG. 16A shows a side view, and a 3-D perspective view of a fourth example structure of a type 2 momentum antenna.

Figure 16B:
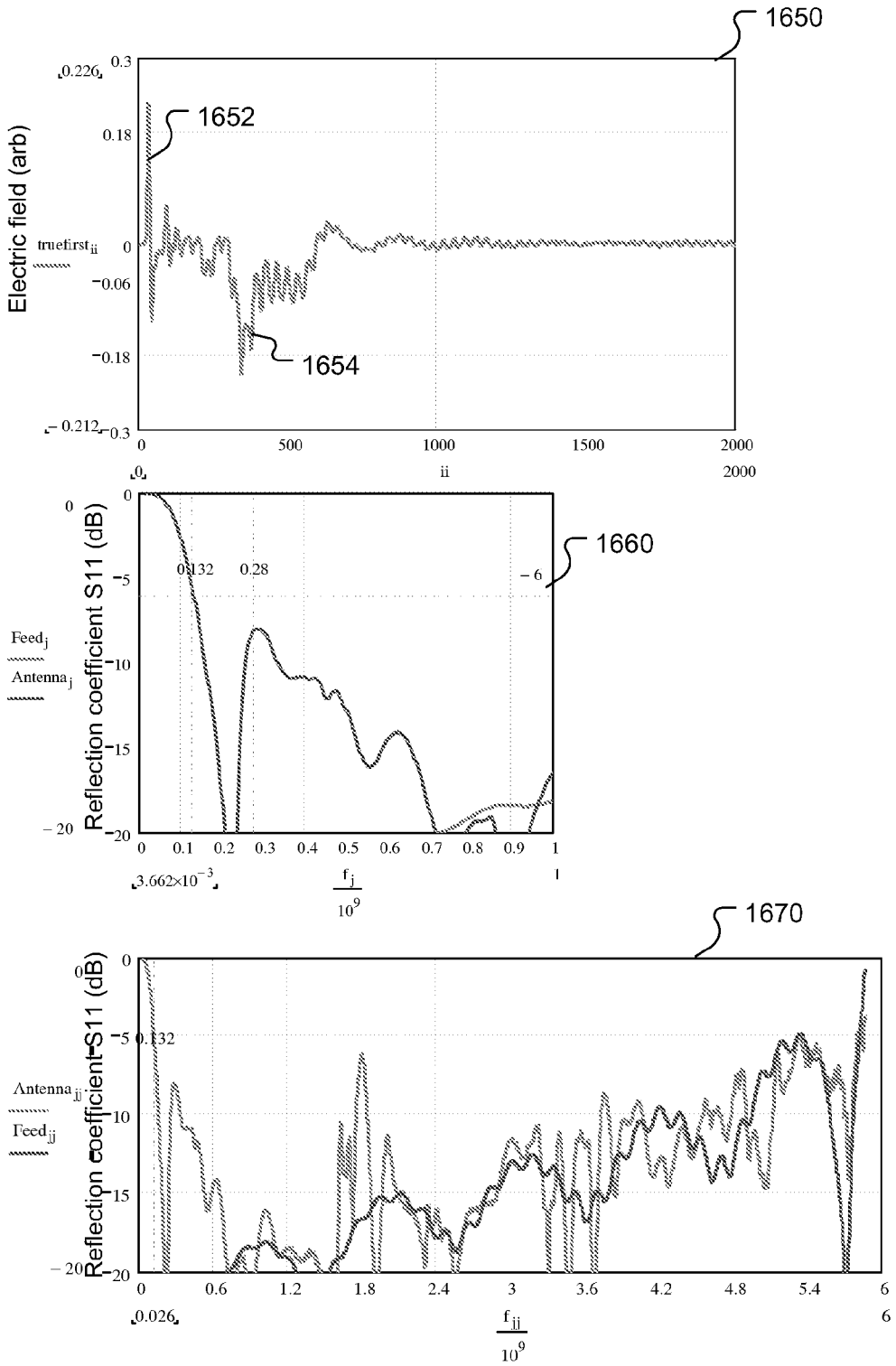

FIG. 16B shows simulations for the fourth example structure of the type 2 momentum antenna shown in FIG. 16A, including the electric field at the device feed vs. time, and the reflection coefficient vs. frequency (over low band—up to 1 GHz, and over broad band—up to 6 GHz).

Figure 17:
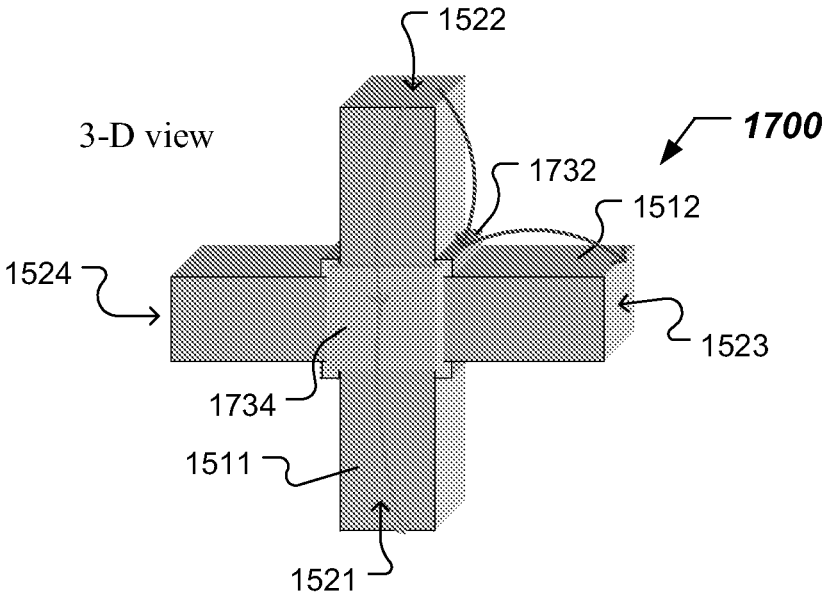
Figure 17:
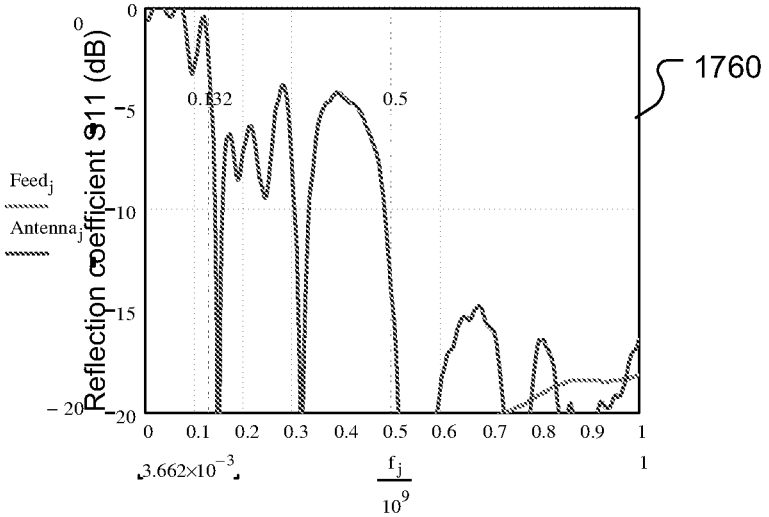

FIG. 17 shows a 3-D perspective view of a fifth example structure of a type 2 momentum antenna, and simulations for the fifth example structure of the type 2 momentum antenna, including the electric field at a given time vs. position along the device, and the reflection coefficient vs. frequency (over low band—up to 1 GHz).

Figure 18A:
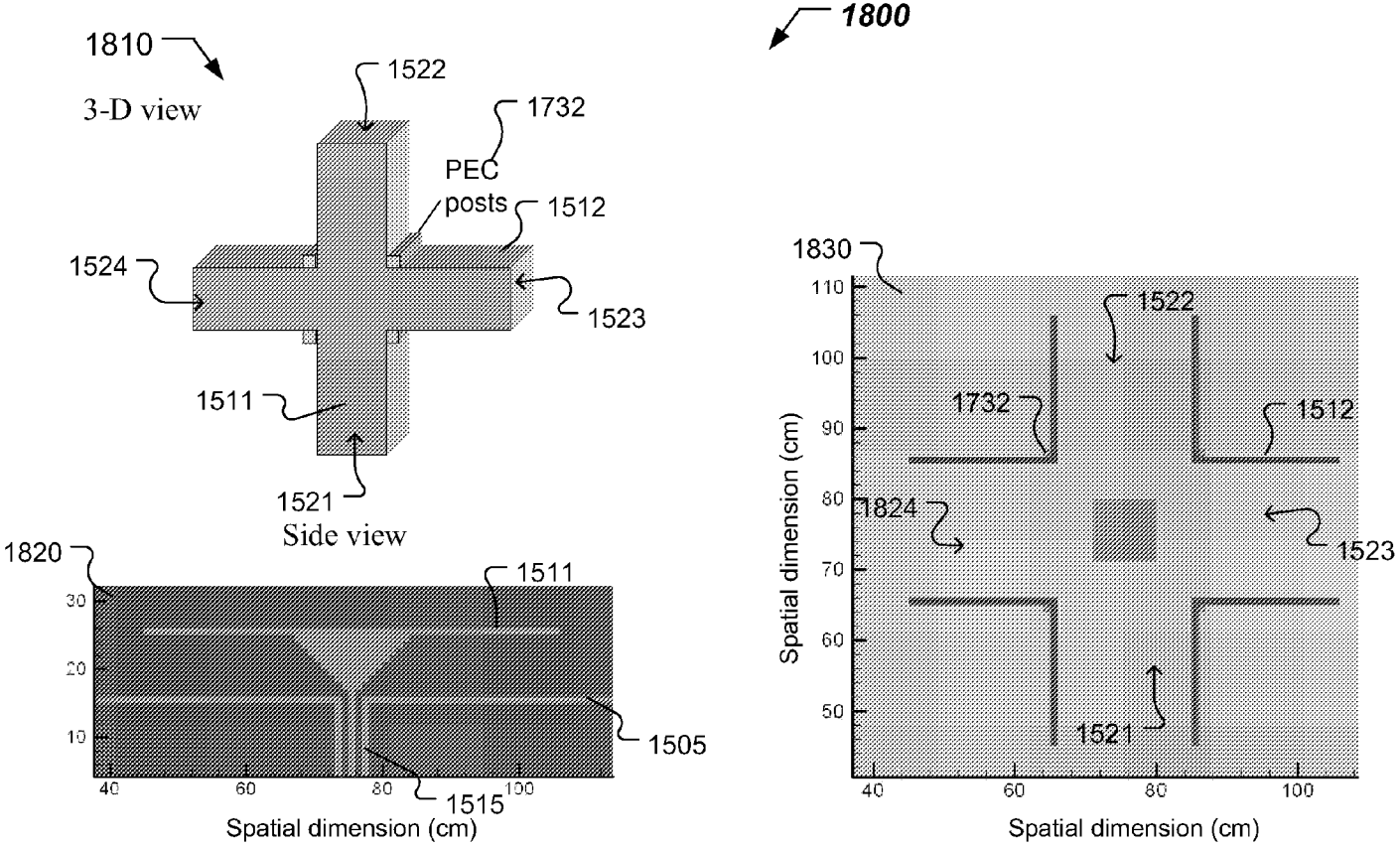

FIG. 18A shows a 3-D perspective view, a side view, and a top view of a sixth example structure of a type 2 momentum antenna.

Figure 18B:
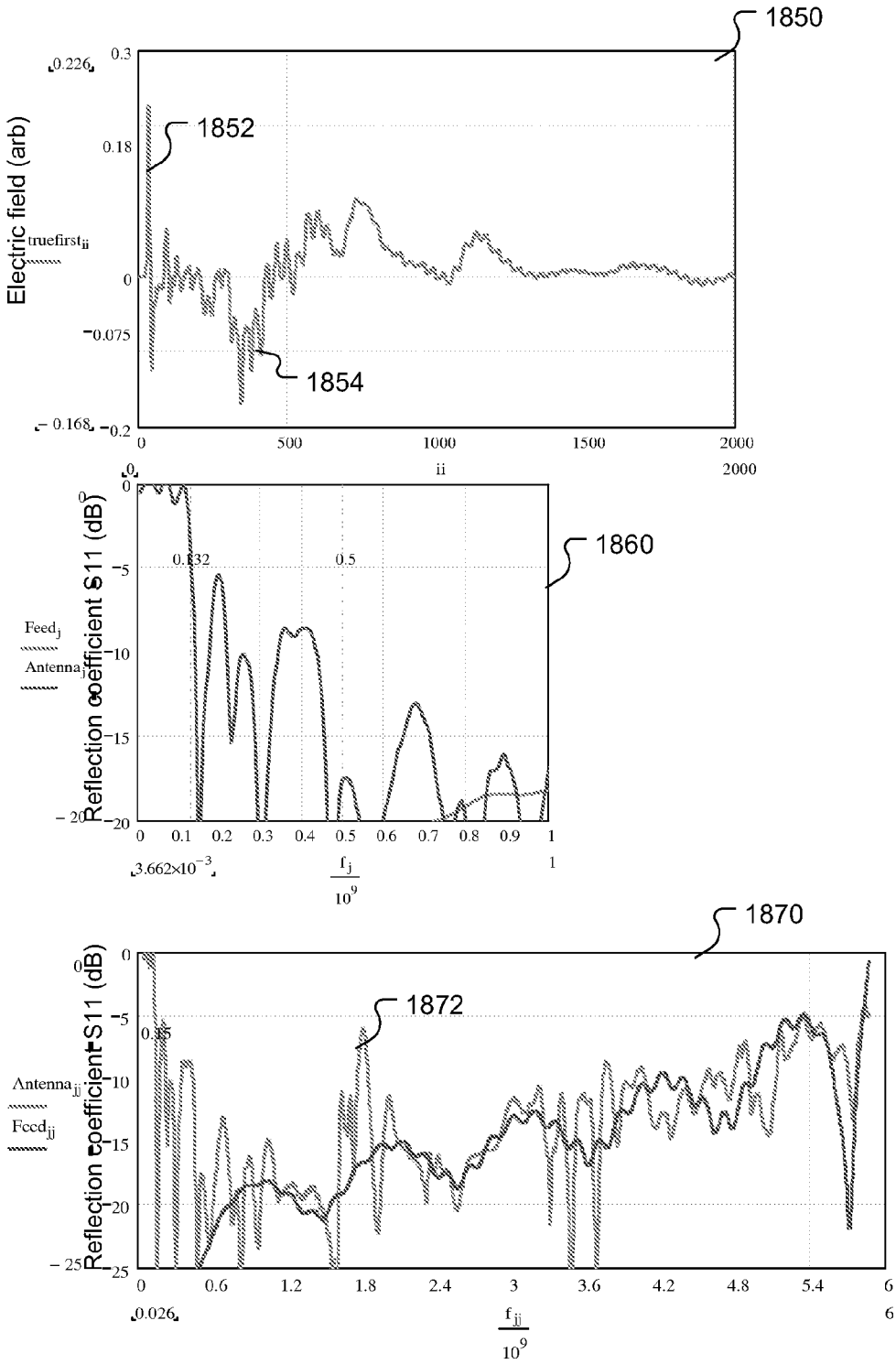

FIG. 18B shows simulations for the sixth example structure of the type 2 momentum antenna shown in FIG. 18A, including the electric field at the device feed vs. time, and the reflection coefficient vs. frequency (over low band—up to 1 GHz, and over broad band—up to 6 GHz).

Like reference symbols in the various drawings indicate like elements.

DETAILED DESCRIPTION

Resonant antennas operating in free-space have a limited Gain-Bandwidth Product (GBWP) known as the Fano-Chu limit. The Fano-Chu limit for the Gain-Bandwidth Product is based on the assumption that the electrically small antenna is perfectly matched in impedance by narrow-band tuning. The large reactance of small resonant antennas (e.g., of the order of thousands of ohms) rapidly changes linearly with the resonant frequency, and the relatively small radiation resistance (e.g., of the order of tenths of an ohm) changes with the square of the frequency. The combination of these two factors suggests that, when a passive reactance is used to eliminate the imaginary part of the antenna impedance, such a resonant antenna can only operate over a narrow band of frequencies around the center resonant frequency and the small radiation resistance needs to be transformed to match the impedance of the transmission line (e.g., typical 50 to 100 ohms) in the antenna transmitter or receiver circuit over that narrow band.

Because of the GBP limit, the conventional approach to broadbanding a resonant antenna, specifically an electrically small antenna, is to add loss to it by either series resistance or nearby absorbing materials. The loss in Gain translates directly to an increase in Bandwidth.

Examples of antennas described here are non-resonant momentum antennas that can be structured as low profile antennas and have an essentially semi-infinite bandwidth of operation for lack of the resonances of resonant antennas. The present non-resonant momentum antennas can be designed to be free of absorbing materials used in the resonant antennas for broadbanding over an operating spectral range and thus exhibit high antenna efficiencies. The antenna efficiency of the present non-resonant momentum antennas can be designed to be a function of the area the antennas occupy on the platform. A momentum antenna is a waveguiding structure with matched radiating discontinuities. Viewed in the time domain, such a momentum antenna is structured so that an input pulse in the momentum antenna travels from the antenna feed towards the discontinuities or terminations of the antenna where it achieves near maximal radiation at the terminations due to the precise balance of termination echoes. The examples of momentum antennas in this document can be designed to have reflection coefficients that are exactly equal and opposite to each other at two terminations (Type 1 momentum antenna) or are reflectionless at the terminations (Type 2 momentum antenna).

For instance, type 1 antennas are different in structure, functionality and operation from other well-known antennas, like the towel-bar and inverted F antenna structures, because the cancellation of the echoes in the time domain leads to broad band matching, as opposed to using the antenna structure to create lumped reactances that match the antenna over specific narrow-bands in frequency domain.

As a result of this behavior, the momentum antennas described in this document can have essentially no reactance and appear to be fed as a purely resistive load of the order of the radiation resistance. Therefore, unlike various resonant antennas which have limited bandwidths, the momentum antennas described in this document can have essentially a semi-infinite bandwidth of operation and their input match (reflection coefficient) at low frequencies obeys an equation of the form:

$$S11(\omega) \cong \frac{R_{rad}(\omega) - Z_0}{R_{rad}(\omega) + Z_0}$$

This is referred to as a Fano-Chu efficiency limit corollary. Hence, antennas with no resonances and increasing efficiency as a function of frequency are possible.

This document provides various examples and technical information on designs and operations of non-resonant momentum antennas. In some the terminating discontinuities of one transmission line are complementary with the opposite transmission line's discontinuity. In some the terminating discontinuities are intrinsically self-complementary. In these examples, the antenna behavior is essentially the same where the energy traveling on the antenna surface makes two round trips over the antenna before being absorbed at the feed. Some of these examples and technical information illustrate designs and operations of antennas with wide to broad bandwidths suitable for various antenna devices and applications.

Figure 1B:
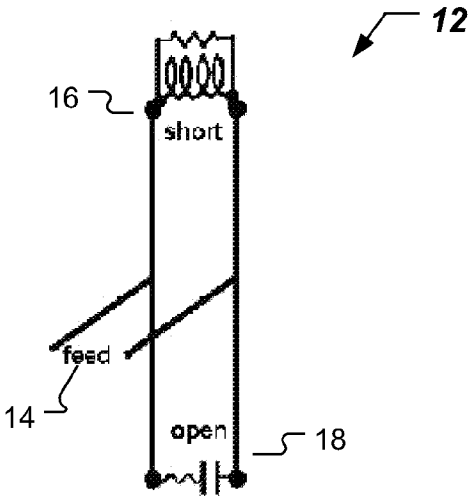
FIG. 1A-B shows a schematic representation of a transmission line terminated in a short at one end and an open at the other end.
Figure 1A:
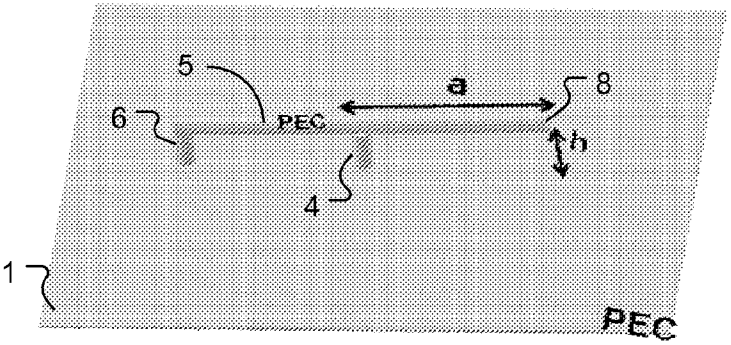

FIG. 1A shows a schematic representation of a momentum antenna 2 terminated at a short circuit 6 to the ground at one end and an open circuit terminal 8 at the other end. The antenna 2 can be configured as a conformal antenna having a transmission line 5 mounted above a metallic or conducting platform 1 for both transmitting and receiving electromagnetic waves. The metallic platform can be, for example, a car, military vehicle, and cell phone frame. The metallic platform 1 can be connected to the electrical ground. The transmission line 5 is connected to a central feed 4 to provide a conductive path between the antenna 2 and an antenna transceiver circuit disposed underneath (or inside) the platform 1. An antenna signal from the transceiver circuit for the antenna 2 is fed through the central feed 4 to be transmitted out by the antenna 2 at the open circuit terminal 8, or an antenna signal received by the antenna 2 is directed to the transceiver circuit via the central feed 4.

The structure of antenna 2 includes a perfect electrical conductor (PEC) plate 1, and a PEC transmission line 5 disposed parallel to, and at a finite distance above the plate 1. The transmission line 5 is terminated at an end in a short circuit PEC terminal 6 connected to the plate 1. The transmission line 5 is terminated at another end in an open circuit terminal 8. The open circuit terminal 8 can include a perfect magnetic conductor (PMC). A feed connector 4 is inserted through an aperture of the plate 1 and is electrically isolated from the plate 1. A first terminal of the feed connector 4 connects to the transceiver circuit and a second terminal of the feed connector 4 connects at or near a middle point of the transmission line 5.

FIG. 1B shows an equivalent circuit 12 of the antenna 2 in FIG. 1A. The open circuit termination 8 corresponds to a capacitive reactance 18, and the shorted termination 6 corresponds to an inductive reactance 16. The total impedance of transmission line 5 can be designed to match the transmission line of the transceiver circuit inside the platform 1, to create a matched circuit from the transceiver to the exterior of the platform 1. Available design parameters of device structures can be adjusted to modify the total impedance of a device structure to match a transceiver feed line of a given impedance for efficient energy coupling between the transceiver and the antenna device.

Figure 2B:
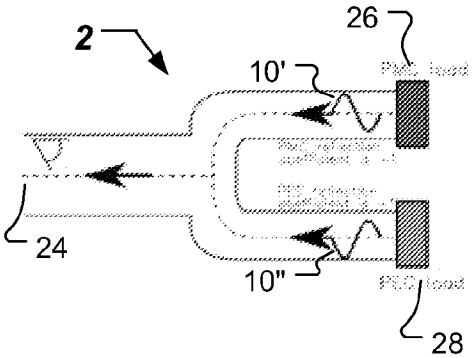
FIG. 2A-B shows another schematic representation of a transmission line terminated in a short at one end and an open at the other end.
Figure 2A:
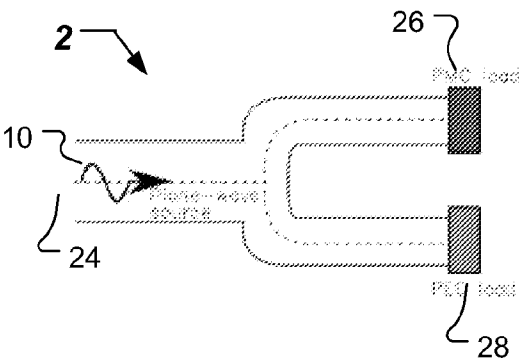

FIGS. 2A and 2B illustrate operations of the antenna 2 at two different times, t1 and t2, respectively. FIG. 2A shows that, at time t1, a transmission line guided wave 10 is launched at the feed 24 towards the two terminations 26 (PMC load) and 28 (PEC load). FIG. 1D shows that, at time t2, reflected echoes 10' and 10" from the two terminations 26 (PMC load) and 28 (PEC load) caused by the injection of the initial pulse 10 are directed back to the feed 24. The transmission line guided wave 10 separates into two guided waves 10' and 10". The separated guided waves 10' and 10" can reach the terminations 28 and 26, respectively, of the transmission line 5, at time t2. Each of guided waves 10' and 10" approaching a corresponding termination carries a finite (non-zero) electromagnetic momentum. The total electromagnetic momentum is conserved during a collision with the terminations of the transmission line 5 based on the momentum conservation:

$$\vec{P}_{incident}(10')=\vec{P}_{radiated}(10')+\vec{P}_{reflected}(10') \quad \text{EQ. 1}$$

$$\vec{P}_{incident}(10'')=\vec{P}_{radiated}(10'')+\vec{P}_{reflected}(10'') \quad \text{EQ. 2}$$

The subscripts "incident", "radiated" and "reflected" in EQs. 1-2 correspond to the guided wave approaching the respective terminations, to the radiated wave and to the reflected guided wave, respectively. The arguments 10' and 10" correspond to guided waves 10' and 10", respectively. Additionally, the guided waves 10' and 10" radiate part of their energy during the collisions with the terminations 28 and 26, respectively, according to energy conservation:

$$E_{incident}(10')=E_{radiated}(10')+E_{reflected}(10') \quad \text{EQ. 3}$$

$$E_{incident}(10'')=E_{radiated}(10'')+E_{reflected}(10'') \quad \text{EQ. 4}$$

The subscripts and arguments of EQs. 3-4 have the same meanings as in EQs. 1-2.

The transmission line 2 operates as an antenna device because electromagnetic energy can be radiated during collisions with terminations of the transmission line 5. Such an antenna is called a momentum antenna because the finite electromagnetic momentum carried by a guided wave before colliding with a termination enables guided electromagnetic energy to continue beyond the termination, on an original propagation direction.

The guided wave 10' reflected at the shorted termination 6 has an inverted amplitude, corresponding to a 180° phase shift acquired during the reflection off the shorted termination 6. The amplitude of the guided wave 10" reflected at the open termination 8 has the same orientation as the incident guided wave 10". If the amplitudes of the reflected waves 10' and 10" are out of phase and also equal in magnitude, then the guided waves 10' and 10" that arrive back at the feed 24 can cancel each other. Such a condition can be achieved if the reflection coefficients are equal and opposite: gamma_short=−gamma_open.

To obtain reflection coefficients equal and opposite, termination discontinuities of the antenna's transmission line 2 can be designed to be complementary. In terms of the equivalent circuit 12, the termination discontinuities of the transmission line are complementary if the terminating admittance, Yt_short, that represents the short circuit 16 is complementary to the terminating impedance, Zt_open, of the open circuit 18:

$$Y_{t_short}=Y_0^2 Z_{t_open} \quad \text{EQ. 5}$$

The parameter Y0 in equation 5 is the admittance of the transmission line guiding the wave. Its inverse is the transmission line impedance Z0. This Impedance is determined by the cross section geometry of the antenna as is well known in Transmission line theory. Momentum antennas rely on balancing the echoes from the open and the shorted ends as is detailed below. For this reason there are preferred proportions that make these echoes easier to match to each other, These proportions are used in the examples below and ion the case of type 1 antennas roughly correspond to transmission line impedances in the 100 to 200 ohm range.

Equivalently, the termination discontinuities of the transmission line are complementary if the terminating admittance, Yt_short, that represents the short circuit 16, matches the terminating impedance, Zt_open, of the open circuit 18. Momentum antennas having complementary termination discontinuities are referred to as the type 1 momentum antennas as described in several exemplary structures of type 1 momentum antenna devices. Available design parameters of device structures can be adjusted to modify the admittance of the shorted termination and the impedance of the open termination of a device structure to obtain complementary termination discontinuities corresponding to type 1 momentum antennas In some implementations, the transmission line 5 of a type 1 momentum antenna can be a perfect electric conductor (PEC) mounted on a PEC platform 1. The shorted termination 6 (or 26) of a type 1 momentum antenna can also be PEC. The PEC used for fabricating a device structure of a type 1 momentum antenna can be a high conductivity metal, for example, Cu. The open termination 8 (or 28) of a type 1 momentum antenna can be a perfect magnetic conductor (PMC). The PMC used for fabricating a device structure of a type 1 momentum antenna can be ferrite. The PMC can also be a high magnetic impedance material, either naturally occurring or artificial. An example artificial high magnetic impedance material is known as artificial magnetic conductor (AMC). In these implementation of the type 1 momentum antennas, the amount or quantity of the PMC material used for fabricating a device structure can be reduced in comparison with other types of broad band, conformal antennas. For example, this document discloses a device structure of a type 1 momentum antenna designed and fabricated from PEC, and that requires no PMC. This document also describes device structures of a type 1 momentum antenna that can be fabricated from PMC. The foregoing devices can be mounted on a PEC platform 1.

Figure 3:
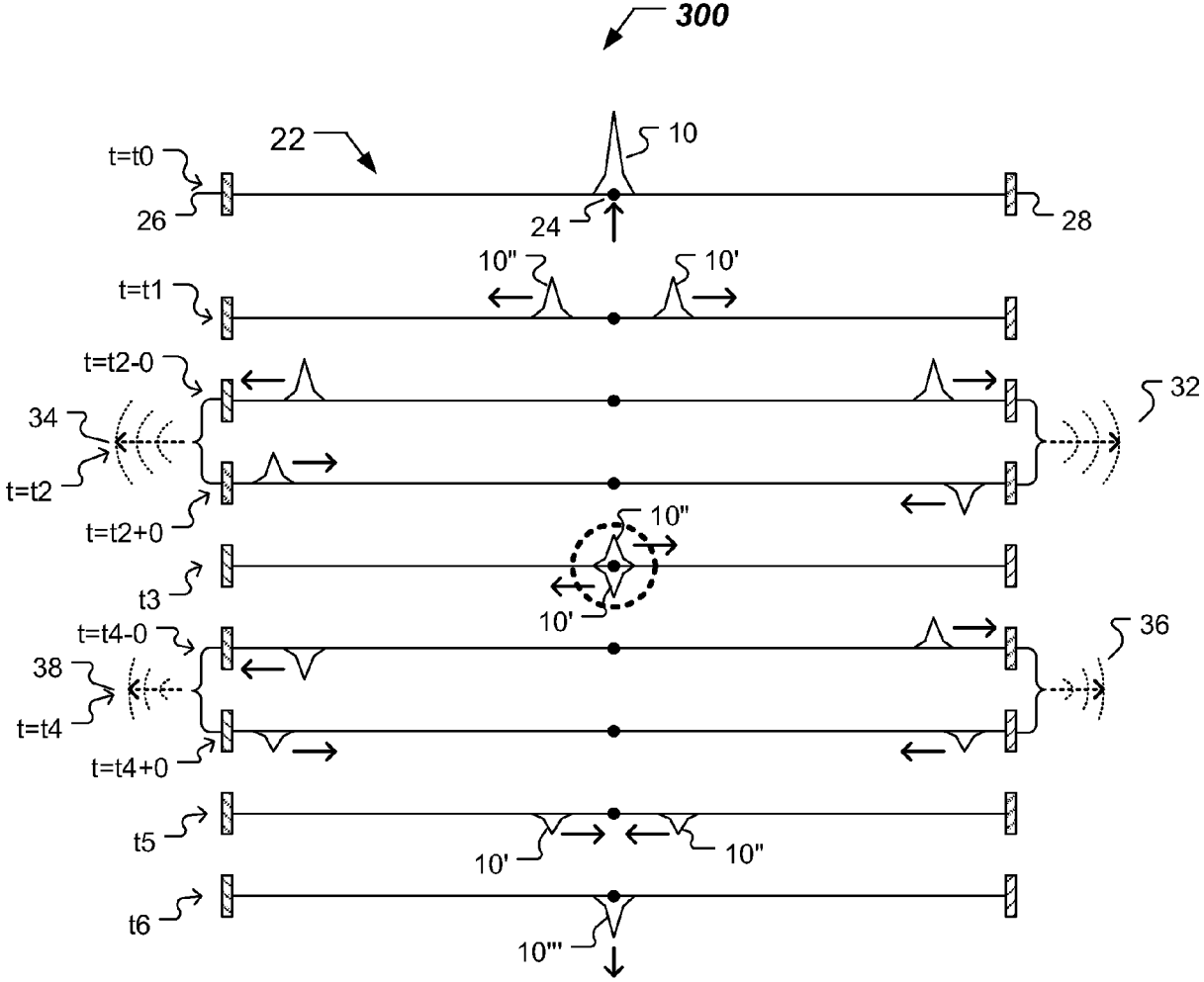
FIG. 3 shows a schematic representation of an example transmission line structure of a type 1 momentum antenna, and shows successive time instances of the electric field vs. location along the structure for a pulse fed to the type 1 momentum antenna.

FIG. 3 shows a schematic representation 300 of an example transmission line structure of a type 1 momentum antenna 22, and, more specifically, shows successive time instances of the electric field pulses at various locations along the structure for a pulse fed to the middle of the type 1 momentum antenna 22. The type 1 momentum antenna 22 can be fed by a transceiver circuit at the center feed 24. An impedance of the center feed 24 can be matched to the impedance of the type 1 momentum antenna 22 for providing optimum energy transfer from the transceiver to the type 1 momentum antenna 22. One end of the type 1 momentum antenna 22 can be terminated in an open 26, and the other end of the type 1 momentum antenna 22 can be terminated in a short 28. The shorted termination 28 can be chosen to be complementary to the open termination 26, as described above in this document.

At t=t0, a time domain pulse 10 can be fed through the center feed 24. The time domain pulse can include, for example, an impulse pulse or a Gaussian pulse.

At t=t1, two time domain pulses 10' and 10" can depart the central feed 24 and travel to the opposite ends, respectively, of the type 1 momentum antenna 22. The joining structure between of the feed 24 and the transmission line of the type 1 momentum antenna 22 can be designed to obtain equal amplitudes of pulses 10' and 10".

At t=t2, the time domain pulse 10' collides with shorted termination 28, while the time domain pulse 10" collides with open termination 26. During the first collision of the time domain pulse 10' with the shorted termination 28, a radiated wave 32 can be emitted from the shorted termination 28 of the type 1 momentum antenna. In this example, a once-reflected pulse 10' has smaller and reversed amplitude compared to the amplitude of time domain pulse 10' prior to the first collision. During the first collision of the time domain pulse 10" with the open termination 26, a radiated wave 34 can be emitted from the open termination 26 of the type 1 momentum antenna. In this example, a once-reflected pulse 10" has smaller and a same orientation amplitude compared to the amplitude of time domain pulse 10" prior to the first collision. The magnitudes of the once-reflected pulses 10' and 10" can be equal due to the complementary nature of the open and short terminations of a type 1 momentum antenna, as discussed above. Pulse locations at times (t2−0) and (t2+0) just before and after the time t2, respectively, are illustrated.

At t=t3, the once-reflected pulses 10' and 10" arrive back at the feed 24 to cancel each other due to their opposite phases. The foregoing cancellation of the once-reflected pulses 10' and 10" can be equivalent to detecting at the feed 24 no first-pass echo of the originally inserted time domain pulse 10. As no energy may be absorbed at the feed 24 in this instance, the once-reflected pulses 10' and 10" can continue traveling on the transmission line.

At t=t4, the once-reflected pulse 10' collides with open termination 26, while the once-reflected pulse 10" collides with shorted termination 28. During the second collision of the once-reflected pulse 10' with the open termination 26, a radiated wave 38 can be emitted from the open termination 26 of the type 1 momentum antenna. In this example, a twice-reflected pulse 10' has smaller and a same orientation amplitude compared to the amplitude of once-reflected pulse 10' prior to the second collision. During the second collision of the once-reflected pulse 10" with the shorted termination 28, a radiated wave 36 can be emitted from the shorted termination 28 of the type 1 momentum antenna. In this example, a twice-reflected pulse 10" has smaller and reversed amplitude compared to the amplitude of once-reflected pulse 10" prior to the second collision. However, the magnitudes of the twice-reflected pulses 10' and 10" can be equal due to the complementary nature of the open and short terminations of a type 1 momentum antenna, as discussed above. Pulse locations at times (t4−0) and (t4+0) just before and after the time t4, respectively, are illustrated.

At t=t5, the two-twice reflected pulses 10' and 10" can return to the central feed 24 from opposite ends, respectively, of the type 1 momentum antenna 22. The returning twice-reflected pulses 10' and 10" have amplitudes that are the same in orientation and magnitude.

At t=t6, the twice-reflected pulses 10' and 10" return at the feed 24 in phase to form a non-zero second-pass echo 10'". The formed second-pass echo 10'" can have a smaller magnitude than the time domain pulse 10, and a delay equivalent to two antenna lengths. The formed second-pass echo 10'" can be absorbed at the feed 24 as the type 1 momentum antenna 22 may be matched to the transceiver. Such an echo 10'" can be equivalent to the echo from a transmission line terminated in a mismatched resistor. Therefore, a transmission line termination mismatch that is resistive and has no reactive component can result in a frequency independent reflection coefficient S11 for a type 1 momentum antenna.

To the degree the transmission line can carry only a transmission line mode the time sequence 200 can illustrate the entire time domain event. However, the echoes can also create common mode currents. Furthermore, the reflected wave from the ends can spread radially outwards from the ends not radially inwards towards the center. Such imperfections can introduce second order reflections.

Figure 4A:
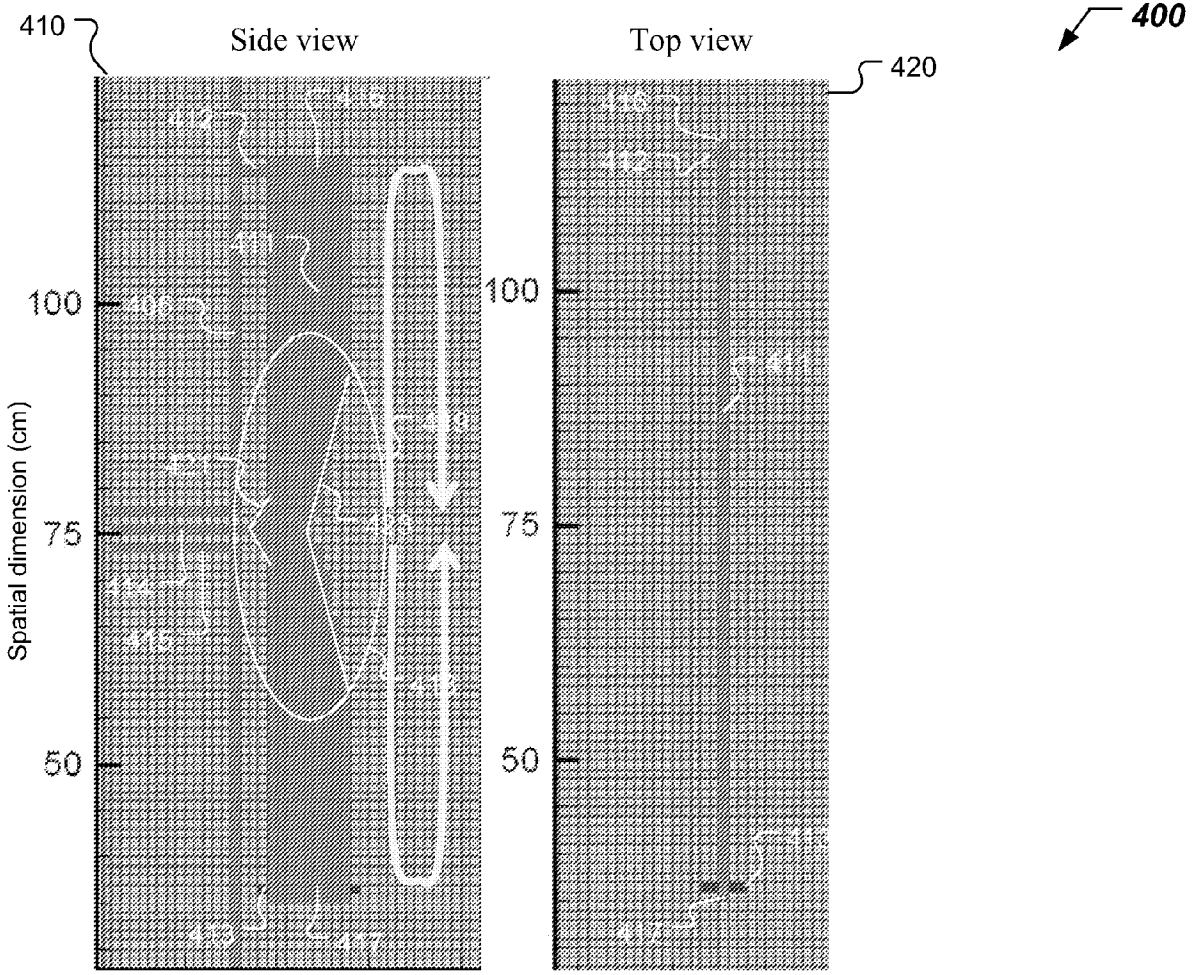
FIG. 4A shows a side view and a top view of a first structure of a type 1 momentum antenna.

FIG. 4A shows a side view 410 and a top view 420 of an example structure 400 of a type 1 momentum antenna. The antenna structure 400 is a single arm type 1 momentum antenna. The units of measurement used in views 410 and 420 are cm, unless otherwise specified.

The antenna structure 400 includes a PEC plate 405 connected to ground. The antenna structure 400 is fed, by transceiver circuitry disposed under the ground plate 405, via a coax feed 415 having a shield connected to an aperture of the ground plate 405. The antenna structure 400 includes a rectangular strip 411 having a long axis disposed parallel to the ground plate 405 and having a short axis perpendicular to the ground plate 405. The strip 411 is separated by a finite distance from the ground plate 405. A center of the strip 411 is placed above the aperture of the ground plate 405 and in contact with a center connector 414 of the coax feed 415 that reaches through the aperture of the ground plate 405. The strip 411 has an edge 416 perpendicular to the ground plate 405 that is terminated in a PEC plate 412 to provide a short circuit terminal connected to the ground plate 405. The strip 411 has another edge 417 perpendicular to the ground plate 405 that is terminated in an open circuit terminal including a PMC choke 413.

The electrical junction of the center connector 414 to a nearest edge of the strip 411 is shaped as a symmetrical taper 421, e.g., an isosceles triangle having a base of a first length and a height of a second length, an apex of the isosceles triangle 421 attached to the center connector 414. An edge of the strip 411 opposite to the junction is shaped to taper into the plate starting at a first distance from both sides of the short axis to a first point of the short axis that is a second distance away from the long axis, to obtain a tapered edge portion 423.

An area of strip 411 inscribed in the ellipse, including the junction 421 and the taper edge portion 423 described above, represents a matching region 418 for coupling a time domain pulse from a coax feed 414 to the strip 411 disposed orthogonally to each other. The matching region 418 includes the above described flare-up edges on one or both sides of the strip 411 to accommodate the spatial variation of the mode of the antenna signal at different locations.

The top view 420 shows the strip 411 having a thickness of about 1 cm. The shape and dimensions of the plate 412 that provides the short circuit terminal and the shape and dimensions of the PMC choke 413 is sized to obtain complementary values for the admittance corresponding to the plate 412 and the impedance corresponding to the choke 413. In this example, the plate 412 can be about 3 cm wide and can be disposed at the middle of the strip 411. The PMC choke 413 can be about 5 cm wide and can be disposed around the strip 411. Such terminating structures can result in reflection coefficients that are equal and opposite in sign. Thus, the reflected pulses returning to the feed for the first time can cancel each other.

For the antenna structure 400 the length, the width and the thickness of the strip 411 can be chosen to obtain a device resistance of 200 ohms Each half of the strip 411, from the coax feed 415 to either end 416 or 417 has a resistance of 100 ohms. The resistances of the two halves of the strip are disposed in parallel for a total resistance of 50 ohms to match the resistance of the coax feed 414.

Figure 4B:
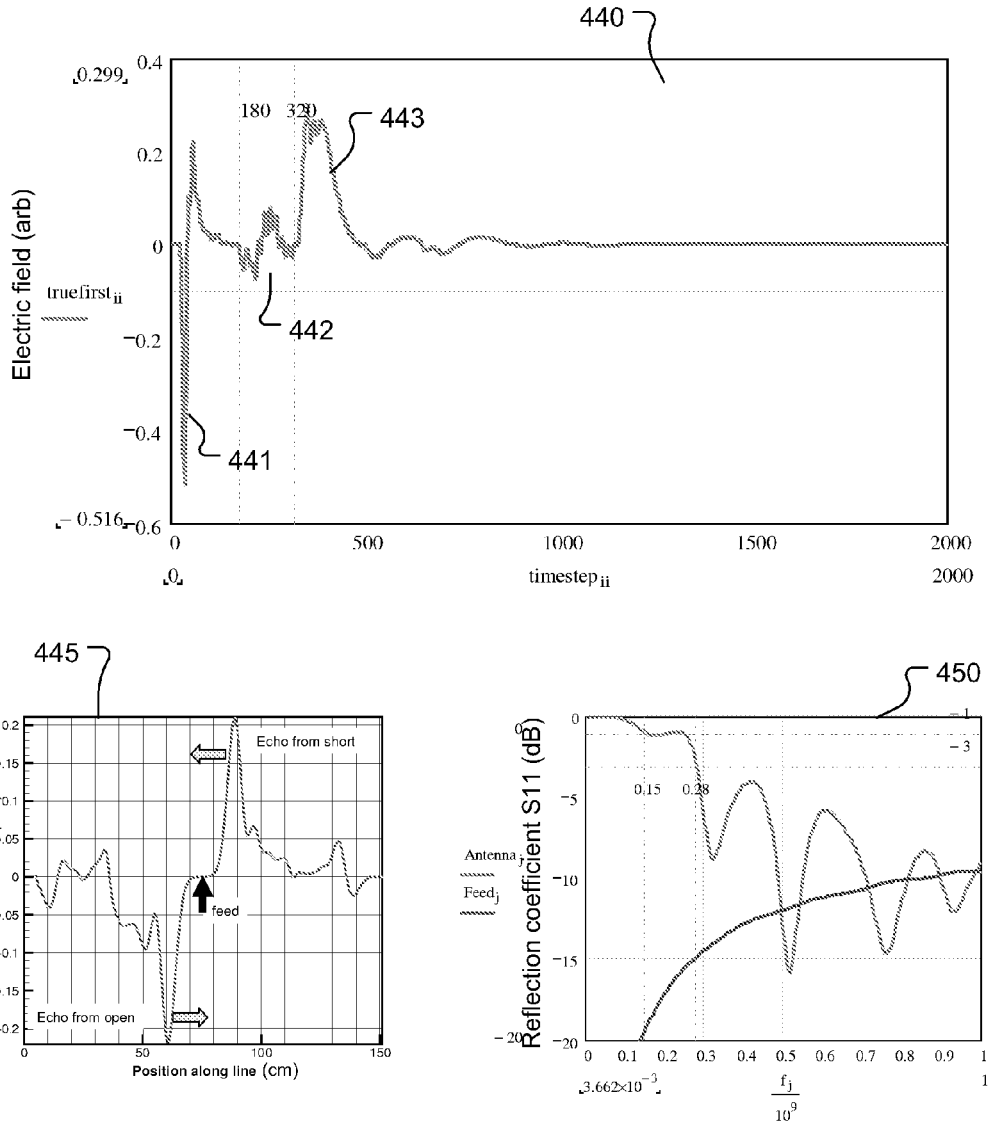
FIG. 4B shows simulations for the first structure of the type 1 momentum antenna shown in FIG. 4A, including the electric field at the device feed vs. time, the electric field at a given time vs. position along the device, and the reflection coefficient vs. frequency (over low band—up to 1 GHz).

FIG. 4B shows simulations for the antenna structure 400 shown in FIG. 4A. Panel 440 shows the electric field at the device feed vs. time. The feed echo 441 is followed by a first pass echo 442, and is later followed by the second pass echo 443. The once-reflected pulses nearly cancel at the time of the first pass echo 442, indicating that the antenna structure 400 has been sized to obtain complementary values for the admittance corresponding to the short plate 412 and for the impedance corresponding to the choke 413.

Panel 445 shows the electric field (denoted 419 in side view 410) at a given time vs. position along the device. The given time for the electric field depicted in panel 445 corresponds to a time between t2 and t3 in diagram 200 of FIG. 2.

Panel 450 shows the reflection coefficient S11 vs. frequency over low band—up to 1 GHz. The antenna structure 400 is 80 cm long, 12 cm high. Note that S11 is about −3 dB at 280 MHz, when the antenna is $\lambda/9$ tall and $0.751\lambda$ long. The first dip in S11 (−1 dB) around 150 MHz corresponds to the antenna height of $\lambda/16$ and 0.4 k long. The feed match is also shown in panel 450. Note that the high frequency performance can be limited by the feed match.

Figure 5A:
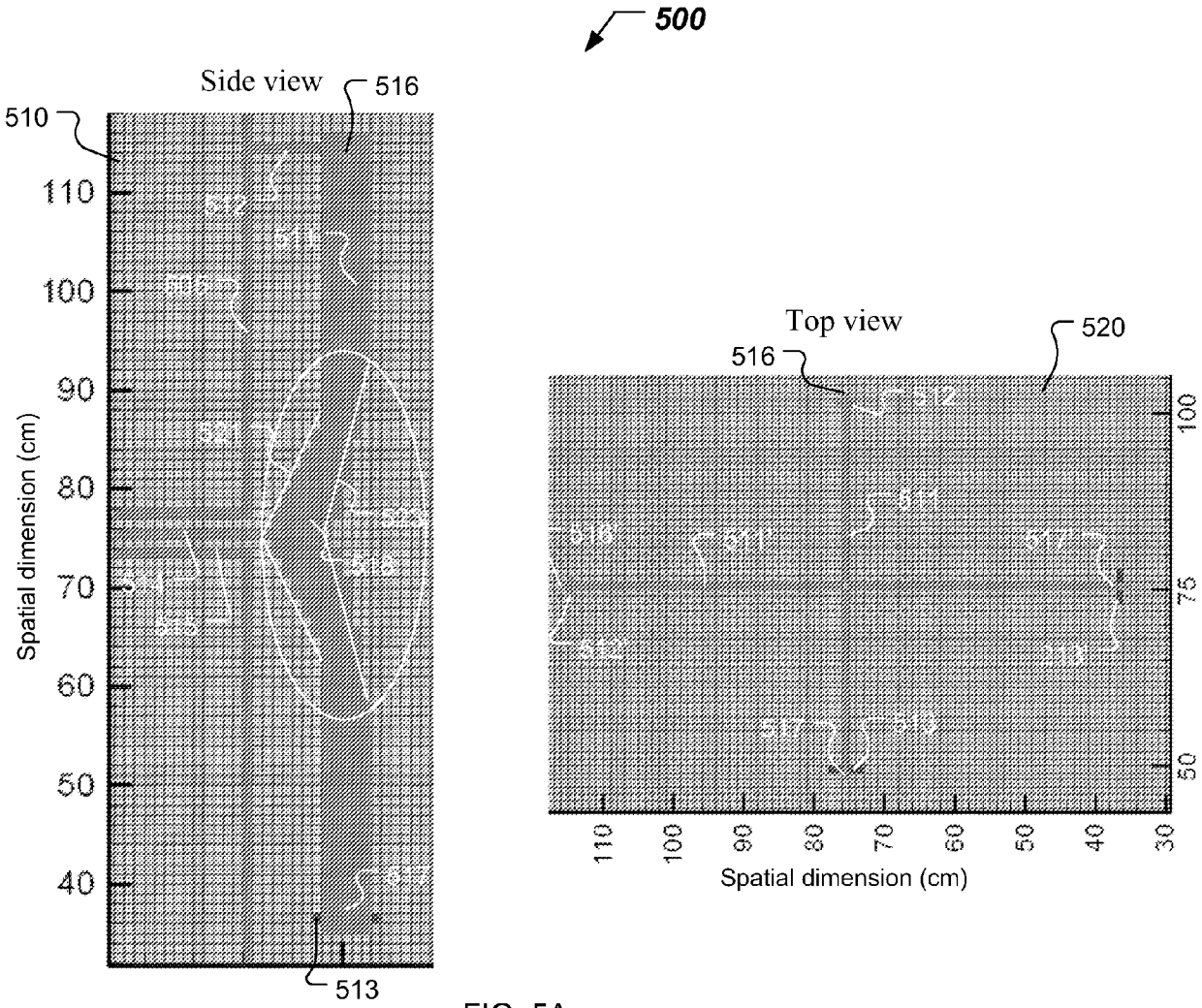
FIG. 5A shows a side view and a top view of a second example structure of a type 1 momentum antenna.

FIG. 5A shows a side view and a top view of an antenna structure 500 in a cross arm configuration having two perpendicular conductive arms 511 and 511'. In the illustrated example, the units of measurement used in views 510 and 520 are cm, unless otherwise specified.

The antenna structure 500 includes a PEC plate 505 connected to ground. The antenna structure 500 is fed, by transceiver circuitry disposed under the ground plate 505, via a coax feed 515 having a shield connected to an aperture of the ground plate 505. The antenna structure 500 includes the first conductive arm 511 in form of a first rectangular strip having a first long axis disposed parallel to the ground plate 505 and having a first short axis perpendicular to the ground plate 505. The first strip 511 is separated by a finite distance from the ground plate 505. A center of the first strip 511 is placed above the aperture of the ground plate 505 and in contact with a center connector 514 of the coax feed 515 that reaches through the aperture of the ground plate 505. The first strip 511 has an edge 516 perpendicular to the ground plate 505 that is terminated in a PEC plate 512 to provide a short circuit terminal connected to the ground plate 505. The first strip 511 has another edge 517 perpendicular to the ground plate 505 that is terminated in an open circuit terminal including a PMC choke 513. The electrical junction of the center connector 514 to the nearest edge of the first strip 511 is shaped as an isosceles triangle 521 having a base of a first length and a height of a second length, an apex of the isosceles triangle 521 attached to the center connector 514. An edge of the first strip 511 opposite to the junction is shaped to taper into the first strip 511 starting at a first distance from both sides of the first short axis to a first point of the first short axis that is a second distance away from the first long axis, to obtain a tapered edge portion 523.

The antenna structure 500 includes a second conductive arm 511' in form of the second rectangular strip having a second long axis disposed parallel to the ground plate 505 and perpendicular to the first long axis of the first strip 511, and having a second short axis perpendicular to the ground plate 505. A length of the second strip 511' can be different from a length of the first strip 511. The second strip 511' is separated by the same finite distance from the ground plate 505 as the first strip 511. A center of the second strip 511' is placed above the aperture of the ground plate 505 and in contact with the center connector 514 of the coax feed 515 reaching through the aperture of the ground plate 505. The second strip 511' has an edge 516' perpendicular to the ground plate 505 that is terminated in a second PEC plate 512' to provide a second short circuit terminal connected to the ground plate 505. The second strip 511' has another edge 517' perpendicular to the ground plate 505 that is terminated in a second open circuit terminal including a second PMC choke 513'. The electrical junction of the center connector 514 to a nearest edge of the second strip 511' is shaped as a second isosceles triangle 521' having a base of a third length and a height of a forth length, an apex of the second isosceles triangle 521' attached to the center connector 514. An edge of the second strip 511' opposite to the junction 521' is shaped to taper into the second strip 511' starting at a third distance from both sides of the second short axis to a second point of the second short axis that is a fourth distance away from the second long axis, to obtain a second tapered edge portion 523'.

An area of first (second) strip 511 (511') inscribed in the ellipse, including the junction 521 (521') and the taper edge portion 523 (523') described above, represents a matching region 518 (518') for coupling a time domain pulse from a coax feed 514 to the first (second) strip 511 (511') disposed orthogonally to each other. The matching region 518 (518') can include the above described flare-up edges on one or both sides of the strip 511 (511') to accommodate the spatial variation of the mode of the antenna signal at different locations.

The top view 520 shows two strips 511 and 511' that are crossed. The strips 511 and 511' can be of different lengths so that the echo from the shorter arm 511 does not return to the feed 515 simultaneously with the echo from the longer arms 521'. The antenna structure 500 can lead to a longer echo than the echo corresponding to the antenna structure 400. Further the echo of the current structure can be half as tall compared to the echo corresponding to the antenna structure 400, because the energy of the feed echo (input pulse) can be divided between the strips 511 and 511'. For example, the antenna structure 500 in FIG. 5 has long arms 511' that are 40 cm long, the short arms 511 that are 27 cm long.

For the antenna structure 500, the widths of the strips 511 and 511' can be thinner than the width of the strip corresponding to antenna structure 400, therefore the equivalent resistance of the antenna structure 500 including four resistances in parallel can remain 50 ohms to match the resistance of the coax feed 514.

The top view 520 shows the first strip 111 and the second strip 111' having a thicknesses of about 1 cm. The shape and dimensions of the first (second) plate 512 that provides the short circuit terminal and the shape and dimensions of the first (second) PMC choke 513 (513') can be sized to obtain complementary values for the admittance corresponding to the first (second) plate 512 (512') and the impedance corresponding to the first (second) PMC choke 513 (513'). In this example, the same short circuit and open circuit terminal sizes can be used for both strips 511 and 511'. For example, the first (second) plate 512 (512') can be about 3 cm wide and can be disposed at the middle of the first (second) strip 511 (511'). The first (second) PMC choke 513 (513') can be about 5 cm wide and can be disposed around the first (second) strip 511 (511'). Such terminating structures can result in reflection coefficients that are equal and opposite in sign. Thus, the reflected pulses returning to the feed for the first time can cancel each other.

Figure 5B:
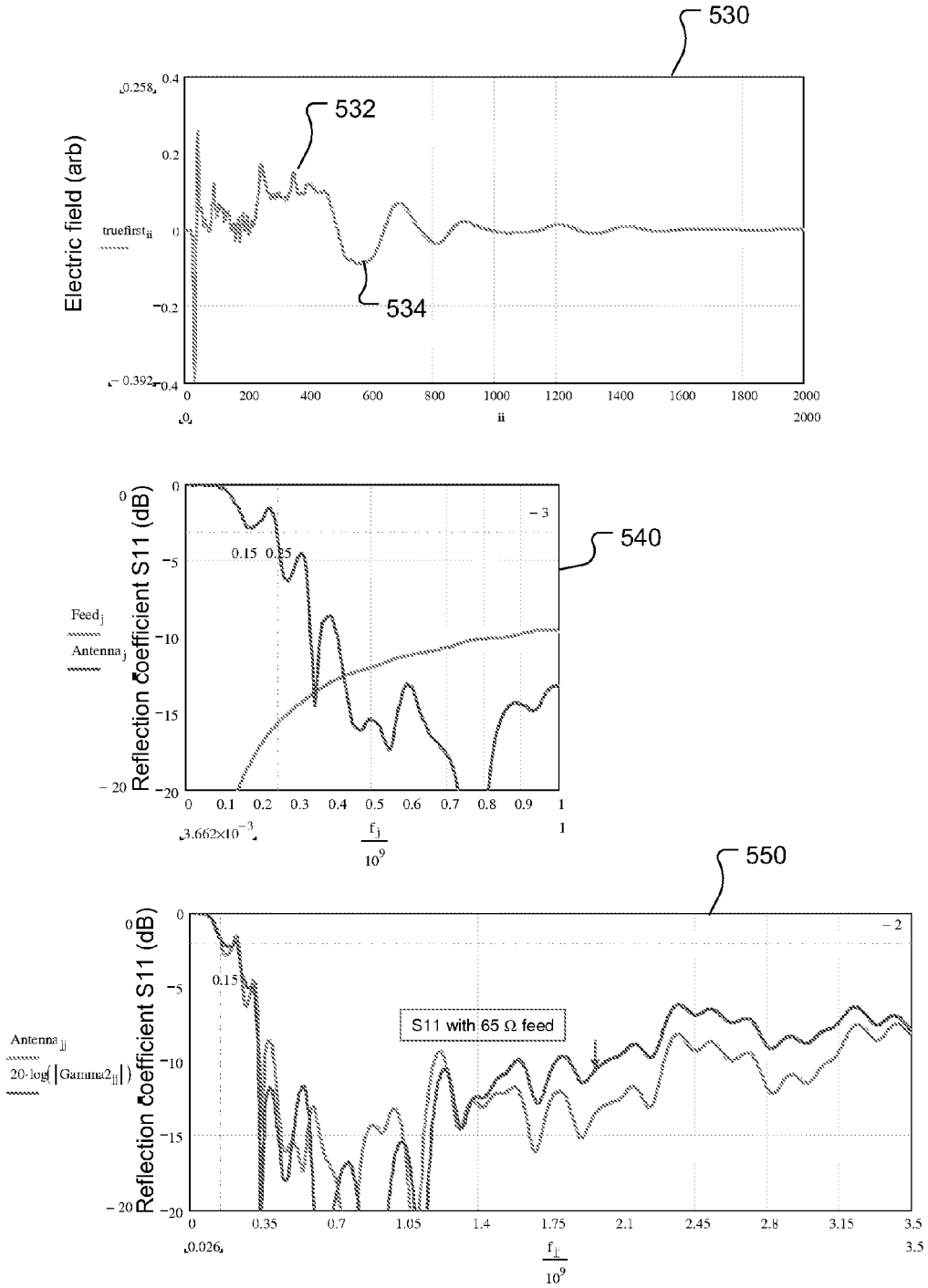
FIG. 5B shows simulations for the second example structure of the type 1 momentum antenna shown in FIG. 5A, including the electric field at the device feed vs. time, and the reflection coefficient vs. frequency (over low band—up to 1 GHz, and over broad band—up to 3.5 GHz).

FIG. 5B shows simulations for the antenna structure 500 shown in FIG. 5A. Panel 530 shows the electric field at the device feed vs. time. The second pass echo 532 starts earlier than, and has half the amplitude of the second pass echo 443 in the case of the single arm antenna 400. In this example, the echo 534 can result from the pulse on each arm hitting the other arm broadside.

Panel 540 shows the reflection coefficient S11 vs. frequency over low band—up to 1 GHz. The antenna structure 500 can show a dip of about −3 dB in the reflection coefficient S11 around 150 MHz. Also, this device has an S11 that can be higher than −3 dB above 250 MHz. Also, note that the match above 250 MHz has improved compared to the corresponding match of device 400 (see panel 450 of FIG. 4B).

Panel 550 shows the reflection coefficient vs. frequency over broad band—up to 3.5 GHz. S11 can be used to calculate the input impedance. Then, the calculated input impedance can be used to simulate S11, for a 65 ohm feed. A change in the feed impedance can tune the strength of the undesired reflections off the feed as the second pulse 532 comes towards the feed. A feed of 65 ohm can lead to a reflection coefficient S11 of about −2 dB from 150 MHz to 250 MHz. Additionally, for a 65 ohm feed, S11 can be about −5 dB at 278 MHz, and less than or equal to −10 dB from 325 MHz to 2 GHz.

Figure 6A:
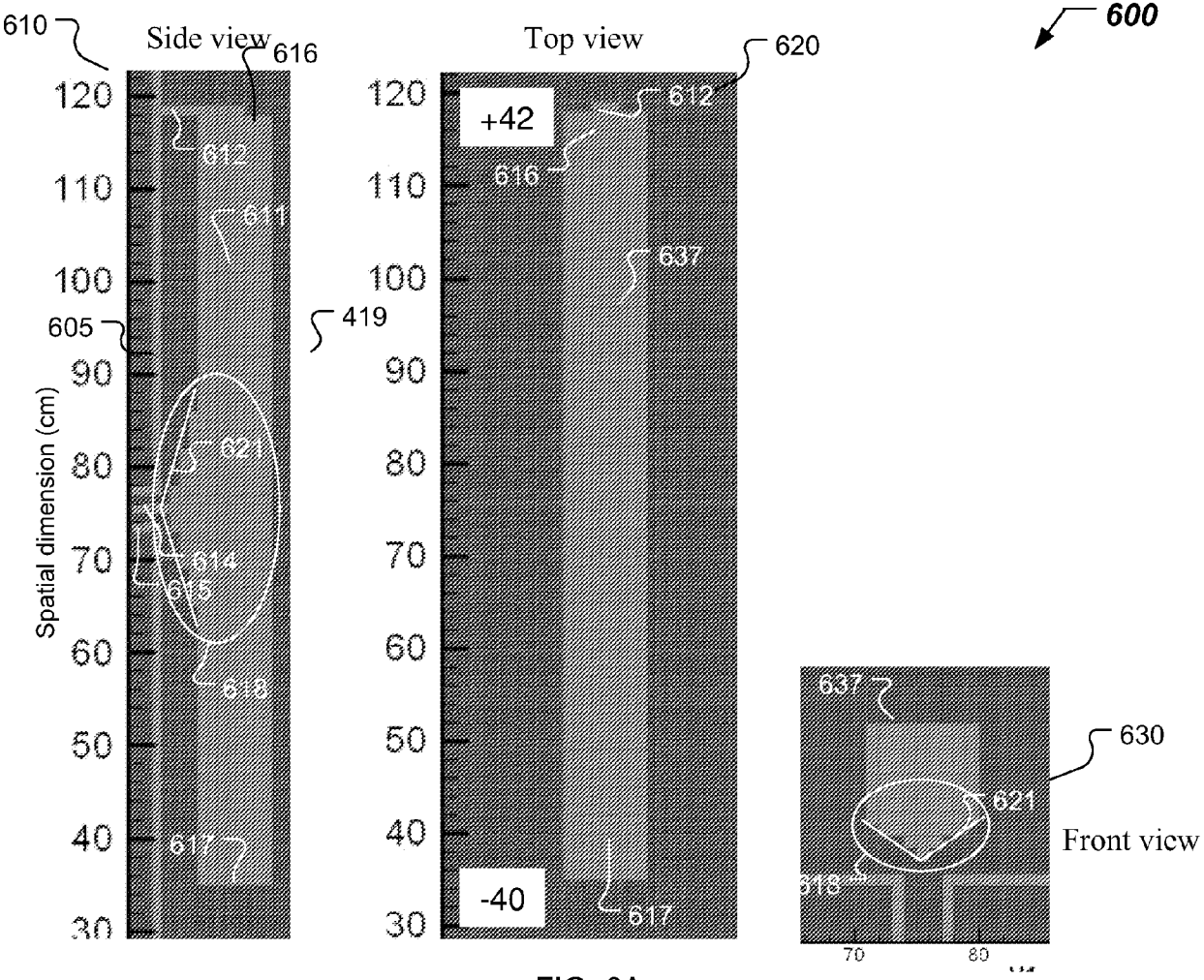
FIG. 6A shows a side view, a top view and a front view of a third example structure of a type 1 momentum antenna.

FIG. 6A shows a side view 610, a top view 620 and a front view 630 of an example structure 600 of a type 1 momentum antenna in a "fatline" type 1 momentum antenna configuration where the dimension of the conductive transmission line along the direction parallel to the ground plate is comparable to the dimension of the conductive transmission line along the direction perpendicular to the ground plate. The units of measurement used in views 610, 620 and 630 are cm, unless otherwise specified. In prior examples for the type 1 momentum antennas, the dimension of the conductive transmission line along the direction parallel to the ground plate is much less than the dimension of the conductive transmission line along the direction perpendicular to the ground plate.

The antenna structure 600 includes a conductive bar 611 and a PEC plate 605 connected to ground. The antenna structure 600 is fed, by transceiver circuitry disposed under the ground plate 605, via a coax feed 615 having a shield connected to an aperture of the ground plate 605. The bar 611 has a rectangular cross section as illustrated in front view 630. The bar 611 has a top surface 637 disposed parallel to the ground plate 605. The bar 611 is separated by a finite distance from the ground plate 605. The bar 611 is placed above the aperture of the ground plate 605 and in contact with a center connector 614 of the coax feed 615 that reaches through the aperture of the ground plate 605. The center connector 614 contacts the bar 611 at a point offset from center of the bar 611 and closer to the end face 617. The bar 611 has an end-face 616 that is terminated in a PEC plate 612 to provide a short circuit terminal connected to the ground plate 605. The bar 611 has another end-face 617 that has a nearly square cross section. The electrical junction of the center connector 614 to a nearest face of the bar 611 is shaped as a rectangular pyramid 621 having a base of a given length, width and an apex of a given height. The apex is attached to the center connector 414.

An area inscribed in the ellipse represents a matching region 618 for coupling a time domain pulse from a coax feed 614 to the bar 611 disposed orthogonally to each other. The matching region 618 can include the pyramid 621 to accommodate the spatial variation of the mode of the antenna signal at different locations.

The shape and dimensions of the plate 612 that provides the short circuit terminal and of the cross section of the open end 617 can be sized to obtain complementary values for the admittance corresponding to the short circuit terminal 612 and the impedance corresponding to the open end 617 having a nearly square cross section illustrated in view 630. In this example, the admittance corresponding to the 9 cm×3 cm wide plate 612 at the short circuit terminal at end 616, substantially matches the open end 617 that has an 8 cm×9 cm cross section. Notably, the magnitude of the echo can be insensitive to variations in the design of the short plate 612. However, the shape of the reflected pulse can be sensitive to the design of the shape of the large cross section 637. However, the antenna structure 600 does not require PMC to obtain the foregoing matching of the short and open ends of the device. Such terminating structures can result in reflection coefficients that are equal and opposite in sign. Thus, the reflected pulses returning to the feed for the first time can cancel each other.

The plate 612 that provides the short circuit terminal can be a PEC. For the antenna structure 600 the length, the width and the thickness of the bar 611 can be chosen to obtain a device resistance of 200 ohms Each portion of the bar 611, from the coax feed 614 to either end 616 or 617 has a resistance of 100 ohms. The resistances of the two portions of the bar 611 are disposed in parallel for a total resistance of 50 ohms to match the resistance of the coax feed 614.

Figure 6B:
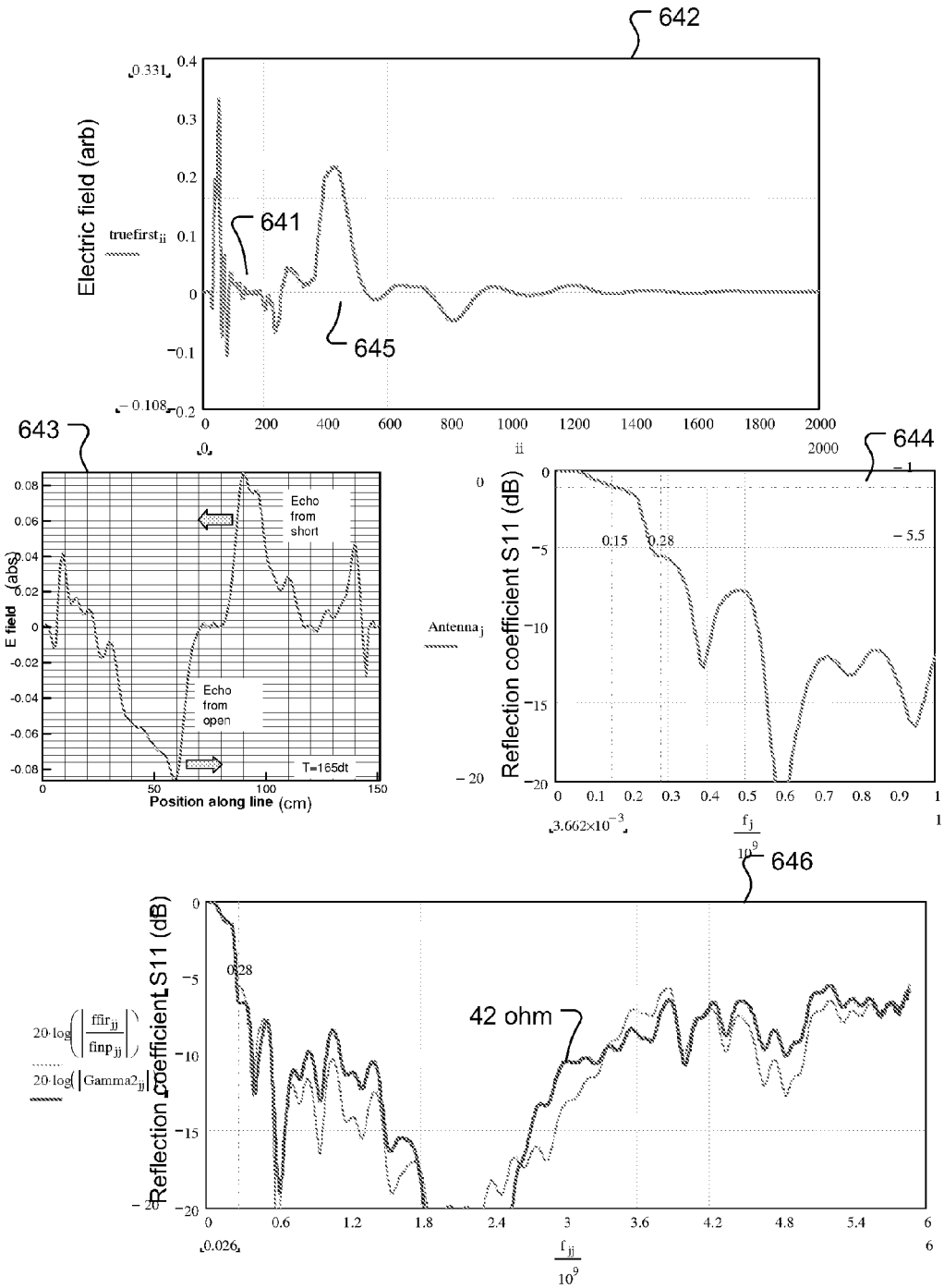
FIG. 6B shows simulations for the third example structure of the type 1 momentum antenna shown in FIG. 6A, including the electric field at the device feed vs. time, the electric field at a given time vs. position along the device, and the reflection coefficient vs. frequency (over low band—up to 1 GHz, and over broad band—up to 6 GHz).

FIG. 6B shows simulations for the antenna structure 600 shown in FIG. 6A. Panel 642 shows the electric field at the device feed vs. time. The first pass echo 641 is later followed by the second pass echo 645. The once-reflected pulses nearly cancel at the time of the first pass echo 641, indicating that the antenna structure 600 has been sized to obtain complementary values for the admittance corresponding to the short plate 612 and the impedance corresponding to the cross section 637of the open end 617.

Panel 643 shows the electric field at a given time vs. position along the device. The given time for the electric field depicted in panel 643 corresponds to a time between t2 and t3 in diagram 200 of FIG. 2.

Panel 644 shows the reflection coefficient S11 vs. frequency over low band—up to 1 GHz. The reflection coefficient S11 of this device can be similar to the reflection coefficient S11 of antenna structure 500 matched with a 65 ohm feed (as shown in panel 540 of FIG. 5B). Notably, S11 has few features at the low frequency end. Also, the current device has an S11 that can be higher than −3 dB for frequencies larger than 280 MHz.

Panel 646 shows the reflection coefficient vs. frequency over broad band—up to 6 GHz. S11 can be about −6.5 dB at 280 MHz, and less than or equal to −6.5 dB from 280 MHz to 6 GHz. S11 results correspond to the 50 ohms coax feed impedance, and to 42 ohms feed impedance.

Figure 6C:
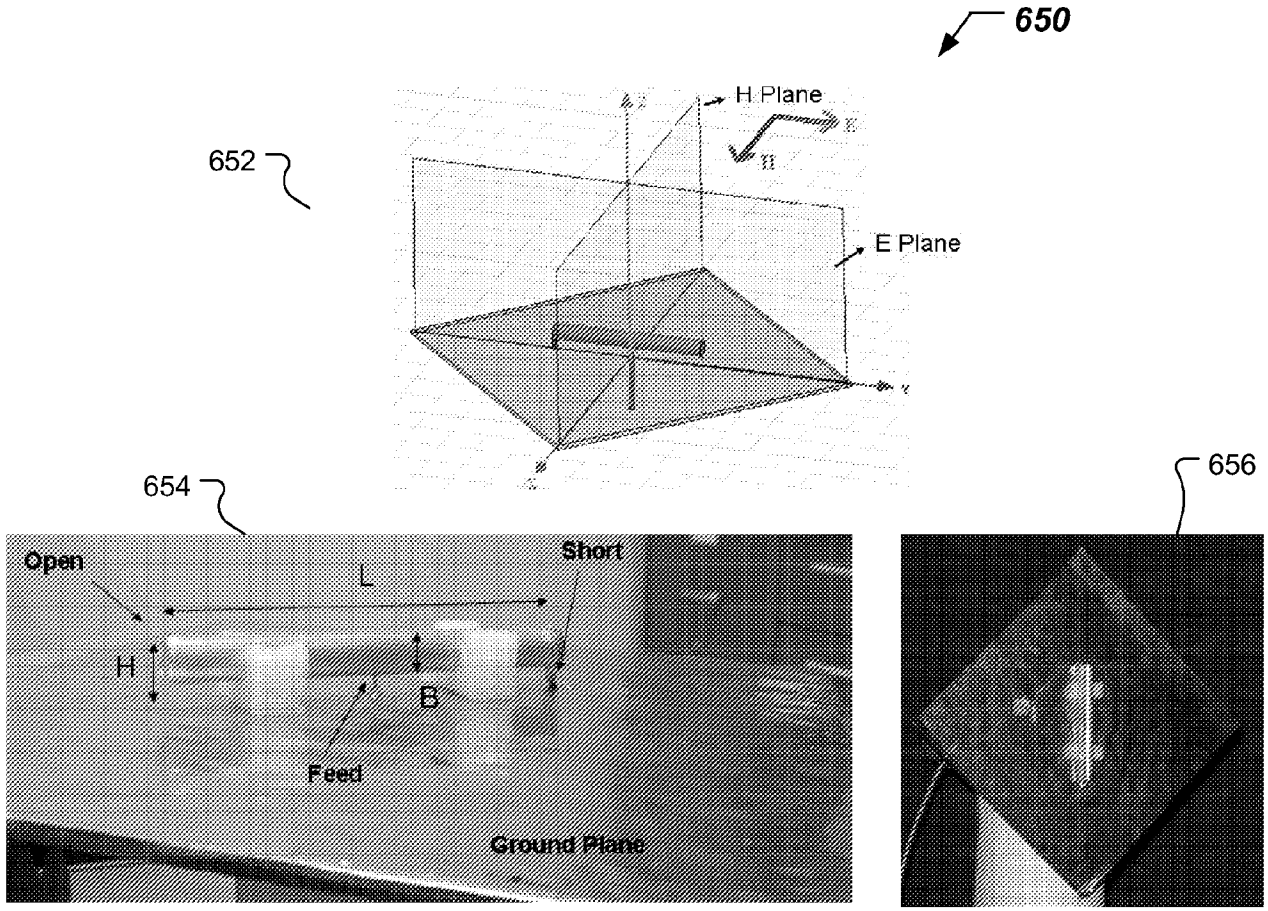
FIG. 6C shows photographs of an actual fabricated sample of the third example structure of the type 1 momentum antenna illustrated in FIG. 6A.
Figure 6D:
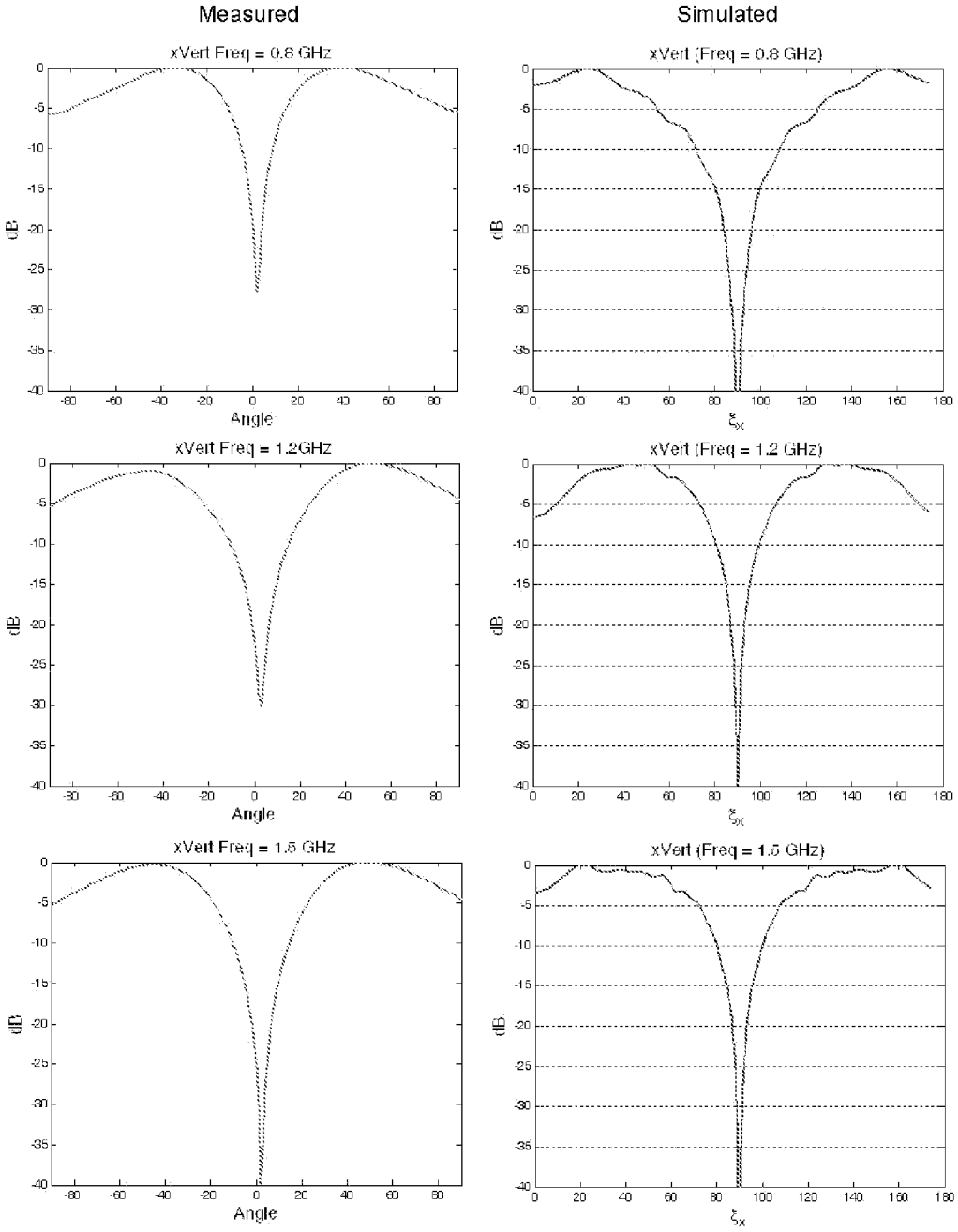
FIGS. 6D-H show measured and simulated radiation patterns for the fabricated sample of the third example structure of the type 1 momentum antenna illustrated in FIG. 6A.
Figure 6E:
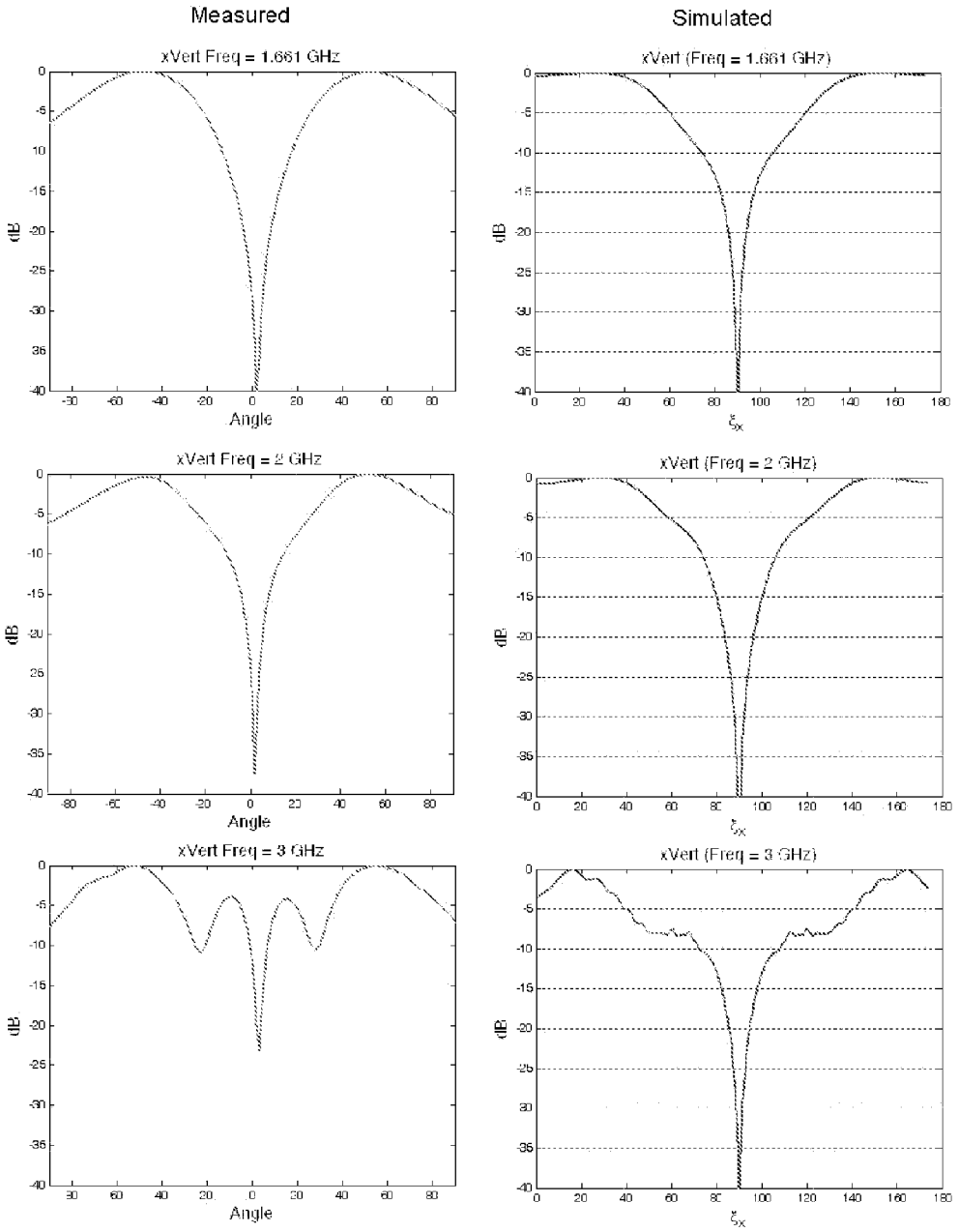
Figure 6F:
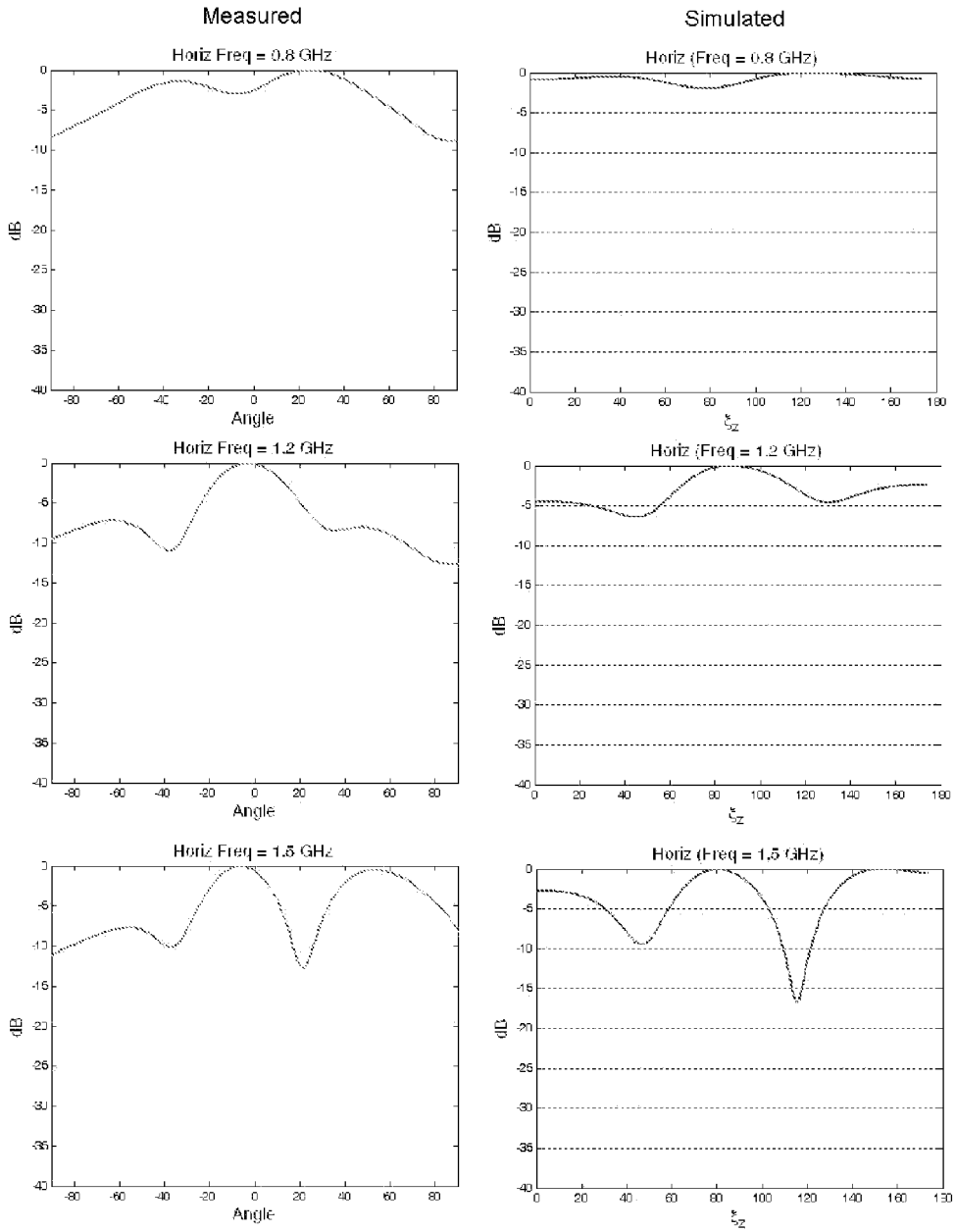
Figure 6G:
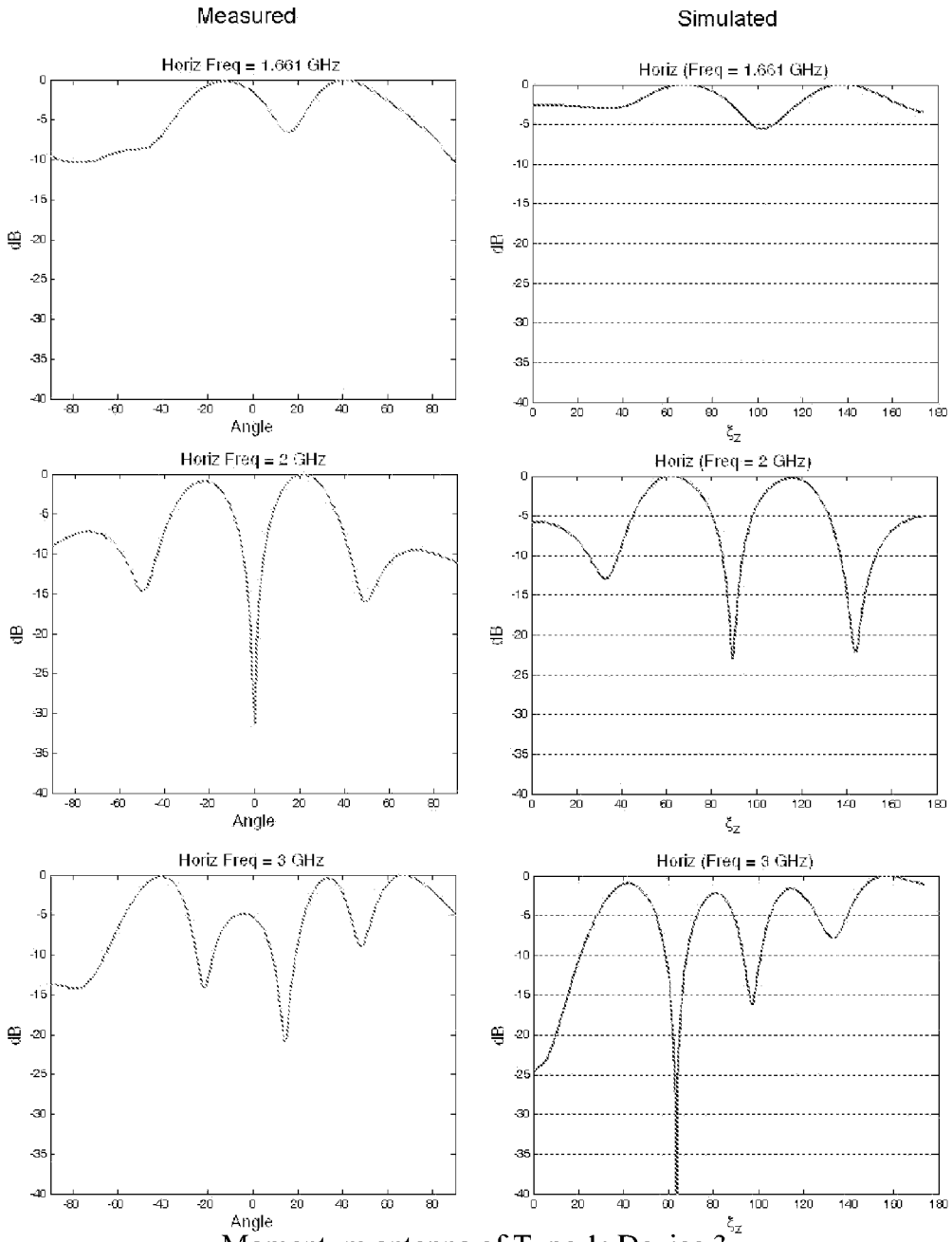
Figure 6H:
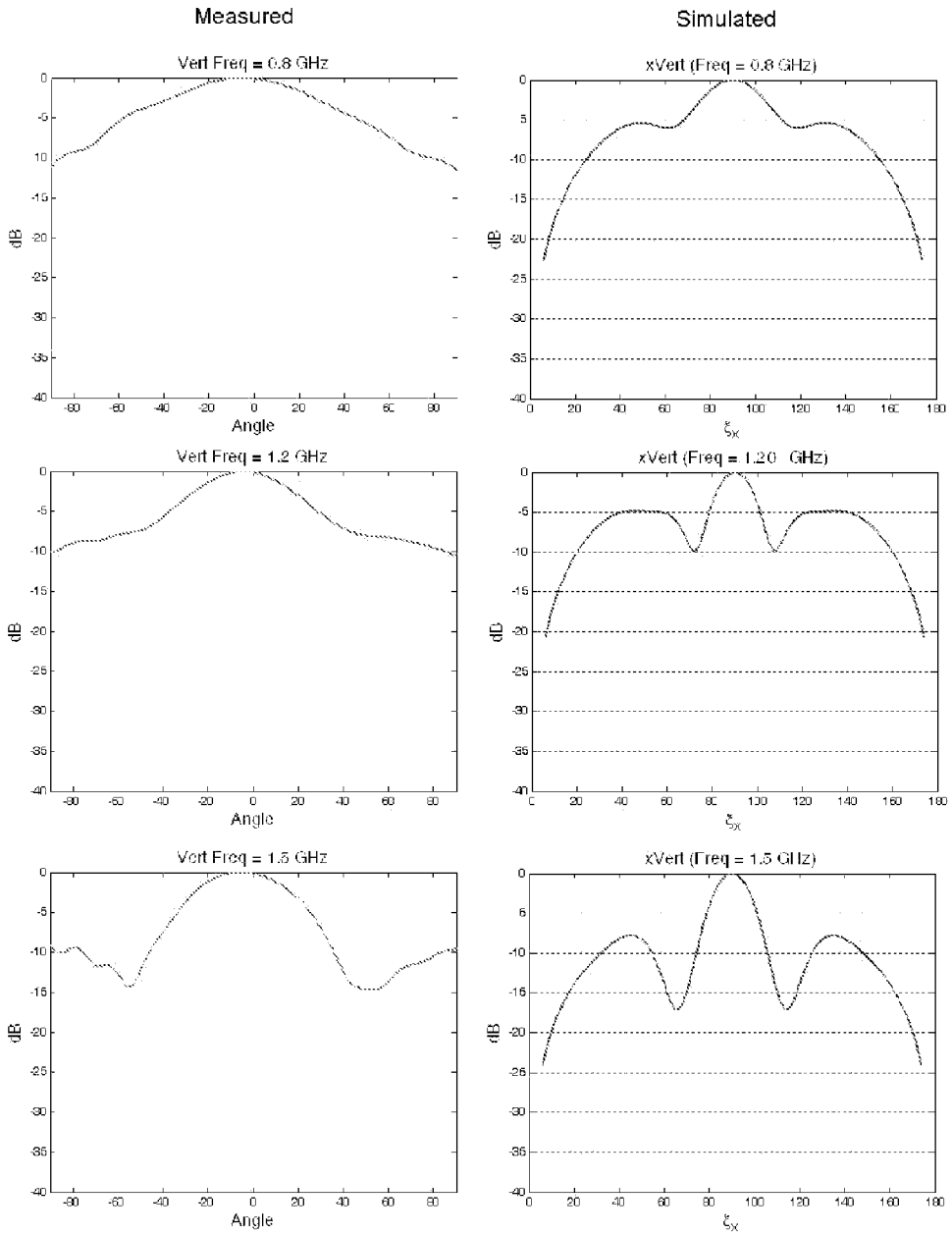

FIG. 6C shows photographs 654 and 656 of an actual fabricated sample 650 of the antenna structure 600 illustrated in FIG. 6A. The fabricated sample 650 was designed and constructed to operate in the frequency band from 600 MHz to 3 GHz. The dimensions of the fabricated sample are: L=Length of the antenna=6"; H=Height above ground=0.9"; B=Thickness of brass pipe=⅝"; Square ground plane dimensions=13"×13". The fabricated sample 650 was placed along the diagonal of the ground plane. The fabricated sample 650 was tested in an anechoic chamber to measure the E-plane co-polar and the H-plane co-polar and cross-polar patterns.

The E-plane and the H-plane relative to the sample orientation are illustrated in panel 652.

FIGS. 6D-H show measured and simulated radiation patterns for the fabricated sample of the antenna structure 600 illustrated in FIG. 6A. The radiation patterns have been measured and simulated in the H- and E-planes, at multiple polarizations and at multiple frequencies. The simulated patterns and the experimental results show agreement over the entire design-band.

Device structures to use as type 1 momentum antennas were disclosed above in this document, each of the device structures can include a PEC (e.g., Cu) wave-guiding element disposed parallel to, and at a finite distance from a PEC ground plane. The wave-guiding element can be connected at one end to the ground plane via a PEC short termination. The other end of the wave-guiding element can be structured to form an open termination. The geometry of the shorted termination and the structure of the open termination can be adjusted to obtain complementary terminations at the endings of the wave-guiding element to obtain a type 1 momentum antenna. Such device structures can be fed time domain pulses and can be operated as type 1 momentum antennas to emit a portion of the electromagnetic energy of the fed time domain pulses.

Another type 1 momentum antenna can be fabricated by placing a PMC wave-guiding element onto a PEC ground plate (i.e., in contact with, and parallel to the PEC plate) to obtain a conformal antenna structure. A conformal antenna conforms in shape to an underlying surface, and therefore conformal antennas can exhibit thin and low profiles, and reduced sizes. The foregoing conformal antenna structure has the PMC wave-guiding element conforming to the underlying PEC plate. These antenna structures are also referred to as "electromagnetically-dual" type 1 momentum antennas. Such antenna structure includes a wave-guiding element that has a short circuit terminal at one end, and an open circuit terminal at the other end. The respective geometries of the short and open circuit terminals can be adjusted to obtain complementary terminations at the endings of the wave-guiding element to obtain a type 1 momentum antenna. Such device structures can be fed time domain pulses and can be operated as type 1 momentum antennas to emit a portion of the electromagnetic energy of the fed time domain pulses.

The type 1 momentum antennas disclosed above in this document include a waveguiding element disposed parallel to, and at a finite distance from a ground plane. In contrast, the electromagnetically-dual type 1 antenna structures can be placed directly onto a PEC ground. The space between the ground plate and the PMC plate forming a conformal waveguiding structure is negligibly small and occupies no significant amount of the volume. Such antennas are referred to as "zero volume" antennas.

FIG. 7 shows a top view 710, and a front view 711 of an example structure 700 of a zero-volume antenna. The units of measurement used in view 710 are cm, unless otherwise specified.

The top view 710 shows that the antenna structure 700 includes a PEC plate 714 as the ground plate and a PMC layer formed directly on the PEC plate 714. The PMC layer is patterned to include two parallel strips 715 and 715' (twin striplines) of equal length, width and cross section that are placed above, and directly in contact with the PEC ground plate 714. The front view panel shows a cross section 711 through strip 715' that is placed in contact with the top surface of the ground plate 714. The strips 715 and 715' are separated by a given distance and are connected at one end by a plate 713 disposed orthogonally to strips 715 and 715'. The plate 713 is fabricated from PMC and provides a provide a short circuit terminal for antenna structure 700. The corresponding open circuit terminal 717 of antenna structure 700 includes the open endings of strips 715 and 715' respectively. Time domain pulses can be coupled into the strips 715 and 715' through a feed structure 712 that connects the middle of strip 715 with the middle of strip 715'. The feed structure 712 is fabricated from PMC and includes a strip line that connects at one end with the strip 715 via a triangular junction, and connects at the other end another with strip 715' via another triangular junction. The junctions of feed structure 712 with the strip lines 715 and 715' have triangular shape to accommodate the spatial variation of the mode of the antenna signal at different locations.

The geometry of plate 713 can be adjusted to render a short circuit terminal that is complementary to the open termination 717. Thus, antenna structure 700 can be operated as a zero-dimensional, type 1 momentum antenna.

The antenna structure 700 can be fed by transceiver circuitry, disposed under the ground plate 714, via a connector having one terminal connected with the transceiver circuitry and a second terminal connected with the center of the feed structure 712. In some implementations, the antenna structure 700 can be fed using a type 2 momentum antenna disclosed later in this document. Signals emitted by the type 2 momentum antenna above the antenna structure 700 and directed to the center of feed structure 712 can couple into strip lines 715 and 715'.

Panel 720 shows the simulated electric field at a given time vs. position along the antenna structure 700. The given time for the electric field depicted in panel 720 corresponds to a time between t2 and t3 in diagram 200 of FIG. 2.

Panel 730 shows the reflection coefficient vs. frequency S11 over broad band—up to 10 GHz. The S11 match can be similar to the S11 match of type I momentum antennas. Therefore, a flat (zero volume) momentum antenna that has "substantially" zero height can be designed to have complementary termination echoes and therefore a semi-infinite impedance match bandwidth.

Other geometries of type 1 momentum antennas are also possible. For example, FIG. 8 shows a top view 810 and a front view 811 of an example antenna structure 800 of a zero-volume antenna in a more complex geometry. The units of measurement used in view 810 are cm, unless otherwise specified.

The top view 810 shows that the antenna structure 800 includes a conducting plate 814. The conducting plate 814 serves as the electrical ground for the antenna and can be, e.g., a PEC structure by using Cu or other conductors. The antenna structure 800 includes strips 815 and 815' placed above and directly in contact with the PEC ground plate 814. The front view panel shows a cross section 811 through strip 815' that is placed in contact with the top surface of the ground plate 814. The strips 815 and 815' are fabricated from PMC. Time domain pulses can be coupled into the strips 815 and 815' through a feed structure 812 that connects the middle of strip 815 with the middle of strip 815'. The feed structure 812 is fabricated from PMC and includes a strip line that connects at one end with the strip 715, and connects at the other end another with strip 715'. A connector 813 connects a first 816 and second 817 ends of strip 815, the first end 816 of strip 815 with the corresponding first end 816' of strip 815', and a first 816' and second 817' ends of strip 815'. The connector 813 is fabricated of PMC and provides a short circuit terminal for antenna structure 800. The corresponding open circuit terminal of antenna structure 800 includes the endings 817 and 817' of strips 815 and 815', respectively.

The specific layout of the components of antenna structure 800 and their associated shapes and geometries are known in the art as the "Schelkunoffs V-antenna". (S. A. Schelkunoff and Harald T. Fris, Antennas: Theory and Practice, New York, Wiley, 1952, pp. 429-454.) For example, the strips 815 and 815' are each shaped in the form of letter V, are connected with the feed structure 812 at the apex of letter V, and are oriented to mirror each other with respect to a long axis of antenna structure 800. The connector 813 is shaped as a circular arc. The layout of Schelkunoffs V-antenna is configured to provide for antenna structure 800 a short circuit terminal that is complementary to the open termination. Thus, antenna structure 800 can be operated as a zero-dimensional, type 1 momentum antenna.

The antenna structure 800 can be fed by transceiver circuitry, disposed under the ground plate 814, via a connector having one terminal connected with the transceiver circuitry and a second terminal connected with the center of the feed structure 812. In some implementations, the antenna structure 800 can be fed using a type 2 momentum antenna disclosed later in this document. Signals emitted by the type 2 momentum antenna above the antenna structure 800 and directed to the center of feed structure 812 can couple into strip lines 815 and 815'.

Panel 820 shows the simulated electric field at a given time vs. position along the antenna structure 800. The given time for the electric field depicted in panel 720 corresponds to a time between t2 and t3 in diagram 200 of FIG. 2.

Panel 830 shows the reflection coefficient vs. frequency S11 over broad band—up to 10 GHz. The S11 shows matching over the entire frequency range except for an undesired anti-resonance around 200 MHz.

Panel 840 shows the efficiency of this antenna structure 800 exceeds 50% for frequencies larger than 88 MHz. This antenna structure 800 has an impedance bandwidth of at least 100:1, where the −3 dB point can be used as the bandwidth boundary. Except for the anti-resonance at 200 MHz, the antenna structure 800 matches the source with a precision of about −6 dB. Thus, the efficiency of this structure can be greater than 75% for frequencies higher than 30 MHz.

The device structures corresponding to type 1 momentum antennas described above can have terminating discontinuities that are so structured that the reflection coefficients corresponding to the terminating discontinuities of a to type 1 momentum antenna are complementary (exactly opposite to each other). Specific examples of Type 2 momentum antennas are disclosed in the next sections of this document that have terminating discontinuities that are reflectionless, or intrinsically self-complementary.

FIG. 9 shows a schematic representation of an example TEM waveguide structure 910 of a type 2 momentum antenna in three different views 910-1, 910-2 and 910-3. The antenna structure 910 includes a TEM waveguide in a hollow structure having opposite sides formed by a first PEC plate 930 and a second PEC plate 930', and having other opposite sides formed by a first PMC wall 920 and a second PMC wall 920'. The PEC plates can be fabricated from a high conductivity conductor, for example Cu, while the PMC walls can be fabricated from a material that behaves like as a perfect magnetic conductor, for example AMC. An open ending of the antenna structure 910 represents a first aperture 940. An opposite open ending of the antenna structure 910 represents a second aperture 940'. In general, the apertures 940 and 940 have rectangular profiles. In some implementations, for example in view 910-1, the apertures 940 and 940 have square profiles. A feed port 950 can be attached, for example, to the middle of the antenna structure 910 to couple time domain pulses inside the TEM waveguide formed by the first and second PEC plates 930, 930' and the first and second PMC plates 920, 920'.

A wave guided mode can travel inside the TEM waveguide 910 towards the aperture 940. The electric field, E, is represented by parallel vertical lines oriented perpendicular to the first and second PEC plates 930, 930'. The magnetic field, H, is represented by parallel horizontal lines oriented perpendicular to the first and second PMC walls 920, 920'. In this structure, the electric and magnetic fields can be perfect duals of each other rotated by 90°. The lowest order mode of wave guide 910 can be a TEM wave with transmission line impedance of 377 ohms. The aperture (termination) 940 of the type 2 momentum antenna 910 is reflectionless because the geometric configuration of the device 910 is designed such that the electric field echoes and the magnetic field echoes exactly cancel each other as explained below. Guided mode pulses that reach the reflectionless aperture 940 can radiate into space part of their energy.

View 910-2 illustrates that the electromagnetic energy that is not radiated into space wraps around to the outside of the waveguide due to the excess electric capacitance of the PEC plates 930 and the magnetic capacitance of the PMC walls 920. When the TEM wave arrives at the end of the device 910, the aperture 940 acts as an open circuit for the electric (E) field and for the magnetic (H) field. The reflected E field does not change sign during a reflection off an electric open circuit. The reflected H field also does not change sign during a reflection off a magnetic open circuit. However, the magnetic field of the reflected E field exactly cancels the reflected H field. Also, the electric field of the reflected H field exactly cancels the reflected E field. Therefore, the effective reflection coefficient at the open aperture 940 can be exactly zero.

In terms of an equivalent circuit, a radiation event that occurs at the reflectionless termination 940 of the type 2 momentum antenna 910 can be explained in terms of the dual (electrical and magnetic) capacitive terminations canceling each other's reactance, thus leaving the radiation resistance as the only load on the type 2 momentum antenna 910.

View 910-3 shows that the electromagnetic energy that wraps around the outside walls of the device 910 continues to travel away from the aperture 940. The electromagnetic energy travels as a guided TEM mode on the outside walls of the device 910 mode such that the entire TEM mode can be outside the waveguide 940.

FIG. 10 shows a schematic representation 1000 of the example TEM waveguide structure 910 of a type 2 momentum antenna, and shows successive time instances of a TEM pulse vs. location along the structure 910. The terminations of the type 2 momentum antenna 910 consist of aperture 952 and aperture 954. Representation 1000 can be considered a side view of the PEC plates 930 of structure 910, or of the PMC walls 920 of structure 910. The type 2 momentum antenna 910 can be fed by a transceiver against ground at the center feed port 950. An impedance of the center feed port 950 can be matched to the impedance of the type 2 momentum antenna 910 for providing optimum energy transfer from the transceiver to the type 2 momentum antenna 910.

At t=t0, a time domain pulse 50 can be fed through the center feed port 950. The time domain pulse can include, for example, an impulse pulse and a Gaussian pulse.

At t=t1, the time domain pulse 50 can depart the central feed port 950 to travel towards termination 952 of the type 2 momentum antenna 910. For example, a joining structure between the feed port 950 and the transmission line of the type 2 momentum antenna 910 can be designed to direct the input pulse 50 in the direction of termination 952.

At t=t2, the time domain pulse 50 collides with termination 952. During the collision of the time domain pulse 50 with termination 952, a radiated wave 62 can be emitted from the aperture 952 of the type 2 momentum antenna. The energy that is not radiated wraps around the aperture 952 to the outside walls of device 910 to form the equivalent of two pulses 50' and 50". Pulses 50' and 50" are TEM pulses having amplitudes smaller than half the amplitude of time domain pulse 50 prior to the collision.

At t=t3, the pulses 50' and 50" travel along the outside walls of the TEM waveguide 910 towards the termination 954 of the type 2 momentum antenna 910.

At t=t4, the pulses 50' and 50" collide with termination 954. During the collision of the pulses 50' and 50" with the aperture 954, a radiated wave 64 can be emitted from the aperture 954 of the type 2 momentum antenna. The energy that is not radiated wraps around the aperture 954 to the inside of device 910 to combine into a pulse 50'. Pulse 50'" is a TEM pulse having an amplitude smaller than the sum of the amplitudes of pulses 50' and 50" prior to the collision.

At t=t5, the pulse 50' travels inside the TEM guide towards the feed port 950 of the type 2 momentum antenna 910.

At t=t6, the pulse 50'" arrives at the feed port 950 as the echo of the initial time domain pulse 50. The amplitude of the echo pulse 50' can be smaller than the amplitude of the initial time pulse 50. The echo pulse can be absorbed at the feed port 950 as the type 2 momentum antenna 910 may be matched to the transceiver. Therefore, echo 50'" can be equivalent to an echo from a transmission line terminated in a mismatched resistor. A transmission line termination mismatch that is resistive and has no reactive component can result in a frequency independent reflection coefficient S11 for a type 2 momentum antenna.

FIG. 11 shows a side view of an antenna structure 1100 of a type 2 momentum antenna. A TEM waveguide 910, and described in reference to FIG. 9, is disposed to have an end 940 protruding through a PEC platform 960. The platform can be fabricated from, for example, a good conductor such as Cu. The PEC platform 960 can be connected to ground. The antenna structure 1110 includes a hollow, rectangular tube having opposite sides formed by a first PEC plate and a second PEC plate, and having other opposite sides formed by a first PMC wall and a second PMC wall. An open ending of the antenna structure 910 represents a first aperture 940. In this example, the first aperture 940 protrudes above the grounded platform 960. An opposite open ending of the antenna structure 910 represents a second aperture 950. In this example, aperture 950 is used as feed port to couple time domain pulses inside the TEM waveguide. The antenna structure 1200 is fed by transceiver circuitry, disposed under the ground plate 960, via a connector having one terminal connected with the transceiver circuitry and a second terminal connected with the feed port 950.

The PEC platform 960 can be connected to electrical ground and represents a perfect reflector for waves that may travel on the outside of waveguide 910. The height of antenna structure 1100 above the PEC platform 960, i.e., the distance from the PEC platform 960 to the aperture 940, can be of the order of the aperture size. A length of a type 2 momentum antenna structure, measured from a feed port 950 to an exit aperture 940, is determined by a length over which a waveguided mode can be established in the waveguide 910.

An RF feed is coupled to the feed port 950 that feeds a pulse through the feed port 950 to travel to the waveguide 910 to termination 940. A wave 66 can be radiated into free space during the first collision of the pulse with the aperture 940. The remaining energy of the pulse then can wrap around onto the outside of the TEM waveguide 910 to continue traveling as an externally guided TEM pulse. The pulse traveling on the outside of waveguide 910 can be reflected off the PEC plate 960 to return and to collide with the aperture 940 for a second time. Before re-entering the waveguide 940, the pulse radiates into free space a wave 68. By reciprocity, the power radiated during the first and second collisions is the same, regardless of the direction of incidence of the pulse (from the inside or outside.) No DC power can be radiated by device 1100, since an input (Gaussian) pulse radiates two (Gaussian) pulses of equal and opposite sign separated in time by the round trip distance to the PEC reflecting surface 960.

The pulse re-entering the waveguide following the second collision with aperture 940 can travel back to the feed port 950 where the returning echo can be absorbed by the matched feed port 950. The power radiated by the two interactions with the aperture 940 can be measured as the difference between the power of the input pulse and the power of the echo pulse.

FIG. 12 shows the result of a simulation of the electric field strength vs. time at the feed port 950 of the antenna structure 1100. The input pulse 1232 is followed by the echo (return) pulse 1234. The echo returning from the first collision to the aperture 950 has an amplitude of the order of magnitude of the background noise.

FIG. 13 shows a 3-D perspective view 1300-A, a top view 1300-B, and a side view 1300-C of an example phase-array antenna structure 1300 based on the antenna structure 1100. For example, a set of type 2 momentum antennas 1310-1, 1310-2, . . . (based on the antenna structure 1100 in FIG. 11) can be disposed to protrude through a PEC surface 1360. Because the protrusion height can be on the order of the aperture size, the array structure 1300 can have a low profile, and be suitable for mounting on an airplane body or wing, etc. The placement of the TEM waveguides in the array 1300 can be arranged in various array configurations to achieve a desired radiation pattern, for example, a lattice as shown in top view panel 1300-B.

Side view 1300-C panel shows that the PEC surface 1360 may be curved and that the relative phase of the time domain pulses input to the type 2 momentum antennas of the array structure 1300 can be controlled separately. For example, the waves 1340-1, 1340-2, 1340-3, . . . emitted respectively by type 2 momentum antennas 1310-1, 1310-2, 1310-3, . . . can combine into a directed beam 1350. The directed beam 1350 output by the phase-array 1300 can be customized to have a desired direction, wavefront profile, etc., based on the relative phase of the input pulses.

The antenna structure 910 can be operated as a single type 2 momentum antenna or in combination with other devices based on antenna structure 910 in arrays of type 2 momentum antennas. Other device structures can be designed and fabricated to be operated as type 2 momentum antennas as disclosed below.

FIG. 14A shows a 3D view perspective 1410, a side view 1420, a top view 1430, and a front view 1440 of an antenna structure 1400. The units of measurement used in views 1420, 1430 and 1440 are cm, unless otherwise specified. The 3D view 1410 shows that antenna structure 1400 can be implemented as half of the antenna structure 910 (shown in FIG. 9) placed on a PEC ground plane 1405. Therefore, the input impedance of the TEM line can be about 188 ohms, or about half the input impedance corresponding to antenna structure 910. When fed through a 50 ohm coax, the matching of the antenna structure 1400 can be about 2:1 (50 ohm vs. 94 ohm).

Antenna structure 1400 includes a ground PEC plate 1405. The antenna structure 1400 is fed, by transceiver circuitry disposed under the ground plate 1405, via a coax feed 1415 having a shield connected to a feed aperture of the ground plate 1405. The antenna structure includes a TEM waveguide placed above the ground plate 1405 and centered on the feed aperture. The TEM waveguide includes two parallel PMC walls 1412 placed perpendicular on the PEC ground plane 1405. The PMC walls 1412 are connected at the top by a PEC plate 1411, parallel to the ground plane 1405. The end openings of the TEM waveguide represent radiating terminations of antenna structure 1400, i.e., apertures 1421 and 1422.

An area inscribed in the ellipse represents a matching region for coupling a time domain pulse from a center connector 1414 of the coax feed 1415 to the PEC top plate 1411. The electrical junction of the center connector 1414 to the top PEC plate 1411 is shaped as a rectangular PEC elongated pyramid 1413. The apex of pyramid 1413 is attached to the center connector 1414. The magnetic junction to the PEC walls 1412 is implemented as a PMC half-pyramids 1412 for coupling the magnetic field of the time domain pulse from the center connector 1414 to the PMC walls 1412. The PEC pyramid 1413 and PMC pyramids 1412 can represent transformers between the transceiver circuitry and the PEC plate 1411 and PMC walls 1412, respectively. The transformers have pyramidal shape to accommodate the spatial variation of the mode of the antenna signal at different locations.

FIG. 14B shows simulations for the antenna structure 1400 shown in FIG. 14A. Panel 1450 shows the electric field at the device feed vs. time. The feed echo 1452 is followed by the return pulse 1454. However, subsequent echoes can be detected at the feed on a period equal to the return time. To reduce the subsequent echoes, the feed matching can be improved.

Panel 1460 shows the reflection coefficient S11 vs. frequency over low band—up to 1 GHz. The results of this simulation indicate that the performance of antenna structure 1400 can be comparable to the performance of example devices having structures of type 1 momentum antennas discussed above. (See FIGS. 4B and 6B.)

Panel 1470 shows the reflection coefficient S11 vs. frequency over broad band—up to 6 GHz. The results of this simulation show that the reflection coefficient can track the feed match for high frequencies. Also, a 2.5 GHz periodicity in S11 can be attributed to the physical length of the pyramidal transformer between the coax feed and the top plate.

FIG. 15A shows a 3-D perspective view 1510, a side view 1520 and a top view 1530 of an antenna structure 1500. The units of measurement used in views 1520 and 1530 are cm, unless otherwise specified. The example antenna structure 1500 can be implemented as the structure shown in the 3D-perspective view 1510 placed on a ground plane 1505.

Antenna structure 1500 includes a ground PEC plate 1505. The antenna structure 1500 is fed, by transceiver circuitry disposed under the ground plate 1505, via a coax feed 1515 having a shield connected to a feed-aperture of the ground plate 1505. The antenna structure includes a crossed TEM waveguide placed above the ground plate 1505 and centered on the feed-aperture. The crossed TEM waveguide has a first and second hollow rectangular tubes that have identical dimensions, and that are orthogonally crossed. The crossed hollow rectangular tubes are disposed to have common centers. The crossed TEM waveguide has a PEC top plate 1511 and PMC walls 1512. The base of the crossed TEM waveguide is the ground PEC plate.

The first hollow rectangular tube of the crossed TEM waveguide has open endings corresponding to apertures 1521 and 1522 of the antenna structure 1500. The apertures 1521 and 1522 are the radiating terminations of antenna structure 1500 corresponding to a first direction. The second hollow rectangular tube of the crossed TEM waveguide has open endings corresponding to apertures 1523 and 1524 of the antenna structure 1500. The apertures 1523 and 1524 are the radiating terminations of antenna structure 1500 corresponding to a second direction, orthogonal to the first direction.

An area inscribed in the ellipse represents a matching region for coupling a time domain pulse from a center connector 1514 of the coax feed 1515 to the PEC top plate 1511. The electrical junction of the center connector 1514 to the top PEC plate 1511 is shaped as a PEC square pyramid 1513. The apex of pyramid 1513 is attached to the center connector 1514. The PEC pyramid 1513 can represent a transformer between the transceiver circuitry and the crossed TEM waveguide. The transformer has pyramidal shape to accommodate the spatial variation of the mode of the antenna signal at different locations.

Additionally, the 3D-perspective view 1510 shows the electric field E and the magnetic field H for the antenna structure 1500. For example, the electric field attached to PEC plate 1511 can travel from the feed 1514 to aperture 1522, then—on the outside of structure 1500—to aperture 1521, and back to the feed 1514, as indicated by the electric field lines that connect the apertures. However, the magnetic field attached to the side PMC-walls 1512 can travel from the feed 1514 to aperture 1522, then—on the outside of structure 1500 reflecting broadside at the cross arm—back to aperture 1522, and back to the feed 1514. The broadside reflection of the magnetic field line at the cross arm is due to the fact that a PMC wall 1512 represents a magnetic short (or a perfect magnetic reflector). Therefore, there can be two types of pulses arriving to the feed 1514 after a round trip, as described above.

FIG. 15B shows simulations for the antenna structure 1500 shown in FIG. 15A. Panel 1550 shows the electric field at the device feed vs. time. The feed echo 1552 is followed by the return pulse 1554. The results of this simulation show that subsequent echoes have been reduced to a level of noise.

Panel 1560 shows the reflection coefficient S11 vs. frequency over low band—up to 1 GHz. S11 can be less than −6 dB for frequencies larger than 470 MHz. The results of this simulation indicate increased antenna performance with respect to the antenna structure 1400. (See FIG. 14B.)

Panel 1570 shows the reflection coefficient S11 vs. frequency over broad band—up to 6 GHz. The results of this simulation show that the reflection coefficient can track the feed match with a precision better than −10 dB for frequencies less than 5 GHz. The peak 1572 around 1.8 GHz can be due to the interior wall separation of the antenna structure 1500.

FIG. 16A shows a 3-D perspective view 1610 and a side view 1620 of an example structure 1600 of a type 2 momentum antenna. The units of measurement used in view 1620 are cm, unless otherwise specified. The antenna structure 1600 can be implemented as the structure shown in the 3D-perspective view 1610 placed on a ground plane 1605.

Antenna structure 1600 includes antenna structure 1500 and further includes a PEC pillar 1635 added above, in contact with and at the center of PEC plate 1511. The PEC pillar 1635 has a height equal to a distance from the center of the antenna structure 1600 to any of the apertures 1521-1524 of the antenna structure 1600. The PEC pillar 1635 is added to balance the magnetic short seen by the outer H-field lines at the arms, with an electric short to be seen by the outer E-field lines at the center of the plate 1611.

Additionally, the 3D-perspective view 1610 shows a portion of one round-trip line of the electric field E and a portion of one round trip line of the magnetic field H for the antenna structure 1600. Other electric and magnetic field lines have been omitted for clarity of the drawing. For example, the electric field attached to PEC plate 1511 can travel from the feed 1515 to aperture 1522, then—on the outside of structure 1600 reflecting at the PEC pillar 1635—back to aperture 1522, and back to the feed 1515. The magnetic field attached to the side PMC-walls 1512 can travel from the feed 1515 to aperture 1522, then—on the outside of structure 1600 reflecting broadside at the cross arm—back to aperture 1522, and back to the feed 1515. Therefore, both types of pulses arriving at the feed 1515 after a round trip have gone through a perfect reflection, as described above.

FIG. 16B shows simulations for the example structure 1600 of the type 2 momentum antenna shown in FIG. 16A. Panel 1650 shows the electric field at the device feed vs. time. The feed echo 1652 is followed by the return pulse 1654. However, the magnitude of the return echo can be reduced compared to the return echo for the antenna structure 1500. Further, the trailing part of echo 1654 resembles the shape of a returning echo of a type 1 momentum antenna.

Panel 1660 shows the reflection coefficient S11 vs. frequency over low band—up to 1 GHz. S11 can be less than −6 dB for frequencies larger than 132 MHz.

Panel 1670 shows the reflection coefficient S11 vs. frequency over broad band—up to 6 GHz. The results of this simulation show that the reflection coefficient can track the feed match with an precision better than −10 dB for frequencies less than 5 GHz. The peak 1572 around 1.8 GHz can be due to the interior wall separation of the antenna structure.

FIG. 17 shows a 3-D perspective view of an example structure 1700 of a type 2 momentum antenna. The antenna structure 1700 includes antenna structure 1500. The additional features of antenna structure 1700 relative to structure 1500 are four vertical PEC posts 1732 on the four inside corners of the crossed TEM waveguide, and a PMC plate 1734 placed above and at the center of PEC plate 1511. Each vertical PEC post 1732 is placed on the ground plate and is in contact with the two PMC walls 1512 that form the associated inside corner of the crossed TEM waveguide. The PEC posts 1732 can induce the guided magnetic field on the side PMC walls 1712 to experience an electric short. The PMC plate 1734 can induce the guided electric field on the top PEC plate 1711 to see a magnetic short.

Additionally, the 3-D perspective view shows a portion of one round-trip line of the electric field E and a portion of one round trip line of the magnetic field H for the antenna structure 1700. Other electric and magnetic field lines have been omitted for clarity of the drawing. For example, the electric field attached to PEC plate 1511 can travel from the feed to aperture 1522, then—on the outside of structure 1700 continuing over the magnetic short of the PMC plate 1734—to aperture 1521, and back to the feed. The magnetic field attached to the side PMC-walls 1512 can travel from the feed to aperture 1522, then—on the outside of structure 1700 continuing over the electric short of the PEC post 1732—to aperture 1523. Therefore, both pulses can return to the feed after respective round trips, without experiencing reflections during propagation on the outside of structure 1700.

Panel 1760 shows the reflection coefficient S11 vs. frequency over low band—up to 1 GHz. S11 can be on the average −5 dB from 132 MHz to 500 MHz, and less than −10 dB for frequencies larger than 500 MHz.

FIG. 18A shows a 3-D perspective view 1810, a side view 1820, and a top view 1830 of an example structure 1800 of a type 2 momentum antenna. The units of measurement used in views 1820 and 1830 are cm, unless otherwise specified. The antenna structure 1800 can be implemented as the structure shown in the 3D-perspective view 1810 placed on a ground plane 1505.

The antenna structure 1800 is a modification of antenna structure 1700. Specifically, the PMC plate 1734 placed above and at the center of PEC plate 1511 is being removed from antenna structure 1700 to obtain antenna structure 1800.

FIG. 18B shows simulations for the antenna structure 1800 in FIG. 18A. Panel 1850 shows the electric field at the device feed vs. time. The feed echo 1852 is followed by the return pulse 1854. Echoes that arrive after the return pulse may be reduced by improving feed matching.

Panel 1860 shows the reflection coefficient S11 vs. frequency over low band—up to 1 GHz. S11 can be about −6 dB at about 130 MHz, and less than −8 dB for frequencies larger than 212 MHz.

Panel 1870 shows the reflection coefficient S11 vs. frequency over broad band—up to 6 GHz. The results of this simulation show that the reflection coefficient can be less than −10 dB for frequencies less than 8 GHz. The peak 1872 around 1.8 GHz can be due to the interior wall separation of the antenna structure 1800. The peak 1872 at 1.8 GHz can be reduced, for example, by placing a 400 ohm shunt resistor in the 50 ohm line at a distance of about 18 cm in front of the feed. Such a modification of the feed line can lead to a reflection coefficient of less then −8 dB (over 85% efficiency) over a frequency range from 212 MHz to 5 GHz, while causing an average excess loss of about −0.5 dB over the band.

In summary, device structures of type 2 momentum antennas can be about 10 cm tall and can have an area of 80 cm by 80 cm. The reflection coefficient S11 can be lower than −6 dB (corresponding to more than 75% efficiency) from about 137 MHz to about 6 GHz. At the low frequency end of this range the antenna is $\lambda/22$ tall. This ratio corresponds to a 45:1 bandwidth. The foregoing bandwidth can be increased by optimizing the transformer.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Thus, particular embodiments have been described. Variations and enhancements of the described embodiments and other embodiments can be made based on what is described and illustrated.

What is claimed is what is described and illustrated, including:

1. An antenna device, comprising:

a ground plate formed on an electrically conductive material to provide an electrical ground;

an electrically conductive transmission line disposed parallel to, and at a finite distance above the ground plate; and a feed connector that is inserted through an aperture of the ground plate and is isolated from the ground plate, wherein a first terminal of the feed connector connects to a transceiver circuit placed under the ground plate, and a second terminal of the feed connector connects to about a middle point of the transmission line, wherein:

the transmission line is terminated at an end in a short circuit terminal connected to the ground plate, and is terminated at another end in an open circuit terminal, and a first combination of a shape and dimensions of the short circuit terminal and a second combination of a shape and dimensions of the open circuit terminal are configured to cause an admittance associated with the short circuit terminal to match an impedance associated with the open circuit terminal, such that, during operation of the antenna device, a first pulse that reflects at the short circuit terminal and a second pulse that reflects at the open circuit terminal return through the electrically conductive transmission line to the feed connector and, there, the first and second pulses cancel each other.

2. The antenna device of claim 1, wherein the open circuit terminal includes a perfect magnetic conductor (PMC).

3. The antenna device of claim 1, wherein the open circuit terminal includes ferrite.

4. The antenna device of claim 1, wherein the short circuit terminal is configured to have an admittance that matches the impedance of the open circuit terminal, wherein the impedance of the open circuit terminal is associated with a cross section of the transmission line.

5. The antenna device of claim 1, further comprising:

a second electrical conductive transmission line disposed parallel to, and at the same finite distance above the ground plate as the transmission line, and oriented orthogonally to the transmission line, wherein:

the second transmission line shares the feed connector with the transmission line, and the second terminal of the feed connector connects to about a middle point of the second transmission line, and the second transmission line is terminated at an end in a second short circuit terminal connected to the ground plate, and is terminated at another end in a second open circuit terminal, wherein the second short circuit terminal and the second open circuit terminal are configured to have a second admittance associated with the second short circuit terminal that matches a second impedance associated with the second open circuit terminal.

6. The antenna device of claim 5, wherein a length of the second transmission line is different from a length of the transmission line.

* * * * *

UNITED STATES PATENT AND TRADEMARK OFFICE

CERTIFICATE OF CORRECTION

PATENT NO. : 8,952,857 B2
APPLICATION NO. : 13/061263
DATED : February 10, 2015
INVENTOR(S) : Rodolfo E. Diaz It is certified that error appears in the above-identified patent and that said Letters Patent is hereby corrected as shown below:

In the Claims

Column 27, line 3, in claim 1, after “the” insert -- electrically conductive --.

Column 27, line 15, in claim 1, delete “terminal return” and insert -- terminal propagate --.

Column 27, lines 16-17, in claim 1, delete “and,there,” and insert -- where --.

Signed and Sealed this
Twentieth Day of October, 2015

Michelle K. Lee

Michelle K. Lee
*Director of the United States Patent and Trademark Office*